US007216379B2

(12) United States Patent
Tharalson et al.

(10) Patent No.: US 7,216,379 B2
(45) Date of Patent: May 15, 2007

(54) MULTI-PURPOSE CONVERTIBLE PLAY YARD

(75) Inventors: Douglas Tharalson, Agoura, CA (US); Diana Tharalson, Aguora, CA (US); Bruce Martin, Malibu, CA (US)

(73) Assignee: Arms Reach Concepts, Inc., Malibu, CA (US)

( * ) Notice: Subject to any disclaimer, the term of this patent is extended or adjusted under 35 U.S.C. 154(b) by 0 days.

(21) Appl. No.: 11/054,370

(22) Filed: Feb. 8, 2005

(65) Prior Publication Data

US 2005/0262628 A1 Dec. 1, 2005

Related U.S. Application Data

(62) Division of application No. 10/043,702, filed on Jan. 9, 2002, now Pat. No. 6,877,173.

(51) Int. Cl.
*A47D 7/00* (2006.01)
*A47D 13/06* (2006.01)

(52) U.S. Cl. ..... 5/93.2

(58) Field of Classification Search ..... 5/93.1, 5/97, 100, 113, 98.1, 98.3, 95
See application file for complete search history.

(56) References Cited

U.S. PATENT DOCUMENTS 185,960 A * 1/1877 Powers ..... 5/99.1
620,069 A 2/1899 Cobb
677,717 A * 7/1901 Thomure ..... 5/29
971,058 A * 9/1910 Luke ..... 5/100
1,105,156 A * 7/1914 Oliphant ..... 5/98.1
1,138,451 A 5/1915 Bugele
1,242,509 A * 10/1917 Zatzkin ..... 5/100
1,267,244 A 5/1918 McMillan
1,283,169 A 10/1918 Hasson
1,289,988 A * 12/1918 Whitcomb et al. ..... 5/100

(Continued)

*Primary Examiner*—Patricia Engle
*Assistant Examiner*—Jonathan Liu
(74) *Attorney, Agent, or Firm*—Reed Smith LLP

(57) ABSTRACT

A co-sleeper convertibly adapted for use as a changing table, bassinet or play yard is described. The invention includes a first rigid enclosure that has four walls and a floor with the front wall capable of being positioned at an upper level equal to the remaining walls or at a second lower level. The first enclosure is capable of supporting a second enclosure within it that has four walls, a floor and can support a mattress. The co-sleeper is secured at one side of a parental bed with the co-sleeper mattress positioned a short distance below the level of the mattress of the parental bed. The front wall of the invention is placed in the second, lowered position for use as a co-sleeper or changing table and positioned at the upper level when the invention is used as a play yard or bassinet. The front wall has a fixed lower portion and a raisable upper portion. The upper portion of the front wall is formed as a rigid panel or as a flexible panel and various means are used to maintain the upper portion of the front wall in the upper position. The rigid panel may be hingedly attached to the first enclosure, slide in tracks, pivot or be completely removable. The rigid panel may zip in place or be maintained by a removable cross-rail secured in a passageway at the upper edge of the upper portion of the flexible front wall that attaches to the first enclosure front rails.

8 Claims, 13 Drawing Sheets

U.S. PATENT DOCUMENTS 1,340,694 A * 5/1920 Winget ..... 5/99.1
1,391,566 A * 9/1921 Musselman ..... 5/2.1
1,478,411 A * 12/1923 Walstrom ..... 5/100
1,878,958 A * 9/1932 McCandless ..... 5/97
2,031,284 A * 2/1936 Smith ..... 5/100
2,329,475 A * 9/1943 Lehman, Jr. et al. ..... 5/93.1
2,395,603 A * 2/1946 Wright ..... 5/99.1
2,477,231 A * 7/1949 Bourdon ..... 5/93.1
2,487,636 A * 11/1949 Churchwell ..... 5/99.1
2,599,663 A * 6/1952 Schutzer ..... 5/100
2,632,186 A 3/1953 Berk
2,679,055 A * 5/1954 Ball et al. ..... 5/100
2,691,176 A 10/1954 Saldana
2,834,031 A * 5/1958 Johansen ..... 5/94
2,889,560 A * 6/1959 Carman ..... 5/100
3,002,199 A * 10/1961 Galloway ..... 5/100
3,044,078 A * 7/1962 Hamilton ..... 5/100
3,162,460 A * 12/1964 Davidson ..... 280/647
3,193,849 A * 7/1965 Landry ..... 5/100
3,427,666 A 2/1969 Saxe
3,541,619 A * 11/1970 Morrison ..... 5/100
3,862,455 A * 1/1975 Turski ..... 5/100
3,900,907 A * 8/1975 Mulder ..... 5/100
4,017,918 A * 4/1977 Harris ..... 5/100
4,715,075 A * 12/1987 Shamie ..... 5/93.1
4,811,436 A * 3/1989 Schwartz ..... 5/93.1
4,825,482 A * 5/1989 Paris ..... 5/11
4,999,863 A * 3/1991 Kane ..... 5/98.1
5,148,561 A 9/1992 Tharalson et al.
5,163,191 A * 11/1992 Chan ..... 5/98.1
5,165,124 A * 11/1992 Li ..... 5/100
5,172,435 A * 12/1992 Griffin et al. ..... 5/95
5,201,085 A * 4/1993 Shamie ..... 5/93.1
5,293,655 A 3/1994 VanWinkle et al.
5,339,470 A 8/1994 Shamie
5,349,709 A * 9/1994 Cheng ..... 5/93.1
5,379,469 A * 1/1995 Millis et al. ..... 5/95
5,416,934 A * 5/1995 Bracken et al. ..... 5/93.1
5,430,899 A * 7/1995 Chisholm ..... 5/95
5,548,005 A 8/1996 Kurth et al.
5,553,336 A * 9/1996 Mariol ..... 5/93.1
5,617,593 A * 4/1997 Pham ..... 5/100
5,768,723 A * 6/1998 Eckel ..... 5/93.1
5,778,465 A * 7/1998 Myers ..... 5/99.1
5,802,634 A 9/1998 Onishi et al.
5,845,349 A * 12/1998 Tharalson et al. ..... 5/99.1
5,926,870 A * 7/1999 Branca-Barnes et al. ..... 5/93.1
6,112,347 A * 9/2000 Tharalson et al. ..... 5/95
6,131,218 A * 10/2000 Wang ..... 5/93.1
6,148,456 A * 11/2000 Tharalson et al. ..... 5/99.1
6,155,970 A * 12/2000 Dykes et al. ..... 600/22
6,192,535 B1 2/2001 Warner et al.
6,202,228 B1 3/2001 Cox
6,418,575 B1 7/2002 Cheng
6,430,762 B1 8/2002 Cheng
6,434,767 B1 8/2002 Welsh, Jr.
6,526,608 B1 3/2003 Hsia
6,539,563 B1 4/2003 Hsia
6,550,082 B2 4/2003 Tharalson et al.
6,578,211 B2 6/2003 Tharalson et al.

* cited by examiner

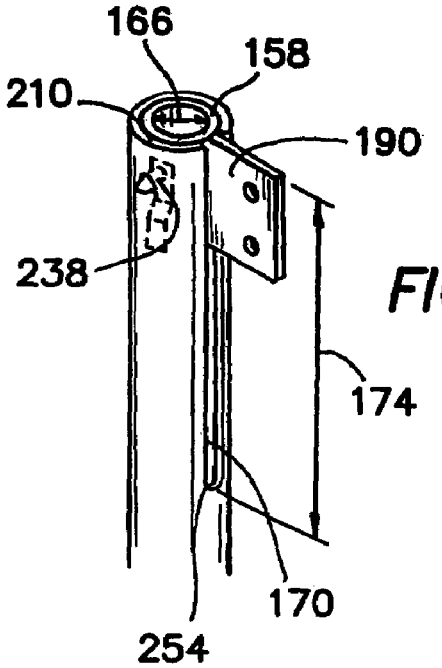
FIG. 5
FIG. 12
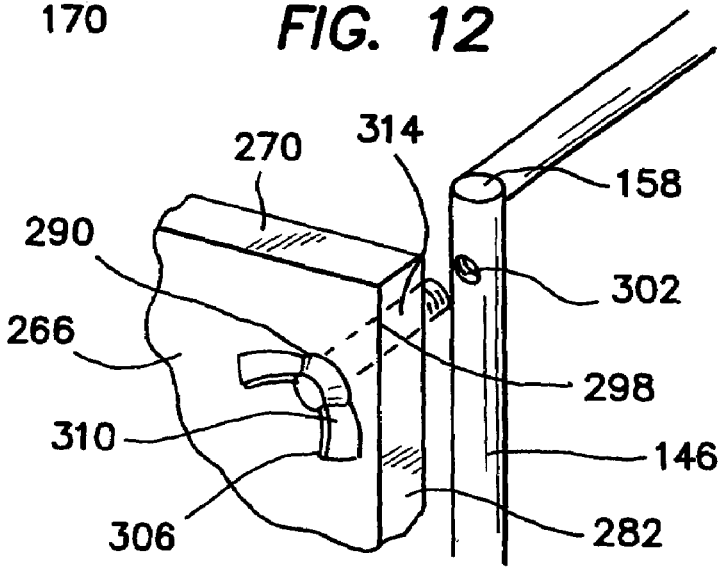
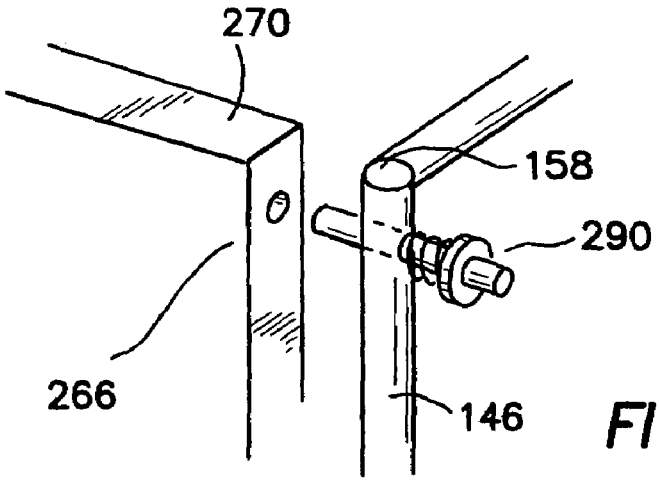
FIG. 13

MULTI-PURPOSE CONVERTIBLE PLAY YARD

PRIORITY INFORMATION

The present application is a divisional of U.S. patent application Ser. No. 10/043,702, filed Jan. 9, 2002, which issued as U.S. Pat. No. 6,877,173, on Apr. 12, 2005.

FIELD OF THE INVENTION

The instant invention relates to the field of convertible units for use with babies and very young children; in particular to units which may be easily converted from a play yard to a bassinet, changing table or child's bed-side sleeping enclosure, hereinafter referred to for convenience as a "co-sleeper", that attaches securely to the parents' bed.

BACKGROUND

Furniture and fixtures for use by babies and small children often presents a problem for parents with limited living space. For this reason it is desirable that such furniture serve more than one purpose. A bedside co-sleeper is very useful for an infant or very young child as it prevents a parent from having to get out of bed to deal with a child requiring minor attention or comforting. If the co-sleeper can then be put to other uses, the parents will save both space and the cost of other furniture. If the co-sleeper can be folded for traveling it will have additional utility. Various examples of such multi-purpose children's furniture have been patented and sold.

In U.S. Pat. No. 5,349,709, issued to Cheng teaches a folding combination playpen and baby bed having an elevated floorboard. U.S. Pat. No. 5,339,470, issued to Shamie discloses a combination foldable playpen and dressing/changing table. U.S. Pat. No. 5,553,336 issued to Mariol adds an upper level to a playpen to provide a bassinet. The short legs of the upper level are inserted into openings in the top of the vertical supports of the playpen. U.S. Pat. No. 2,632,186, issued to Berk et al. discloses a portable combination crib and playpen. U.S. Pat. No. 2,691,176 issued to Saldana teaches a unit designed for home and travel that may be used as a support for a playpen, bassinet or baby chair.

U.S. Pat. No. 5,802,634 issued to Onishi, et al. describes an adjustable bed, suitable for use from infancy to adulthood that includes a bed frame body having pivoting end panels and a height adjustable base. In one adjusted position, with the end panels pivoted to near vertical and the height adjustable base fully raised, the bed is swingable like a cradle, with the bed frame body swingably suspended from the height adjustable base. By lowering the height adjustable base, the near vertical end panels contact the floor, and the bed is useful as a playpen for an infant or a chair for an adult. By pivoting the end panels to intermediate or horizontal positions, the bed becomes useful as a lounge chair or as a bed for a child.

Beside cribs that attached to the parents' bed were known at the turn of the century (U.S. Pat. Nos. 5,548,005; 620,069; 1,138,451; 1,283,169; 1,267,244) but fell out of favor for many years. Recently there has been a resurgence in the practice of having babies adjacent the parents' bed. Such bed-side devices are taught in U.S. Pat. No. 5,172,435 to Griffin et al.; U.S. Pat. No. 5,148,561 to Tharalson et al; and U.S. Pat. No. 5,293,655 to Van Winkle et al. Cox, U.S. Pat. No. 6,202,228, describes a crib securable to the side of a parent's bed that includes an alarm mechanism for sounding an audible alarm when an infant attempts to climb from the crib onto the parent's bed.

It is an objective of the present invention to provide a bedside co-sleeper that can be adapted for use as a changing table, bassinet or play yard. It is a further objective of the invention to provide a co-sleeper with these capabilities that is inexpensive, compact and portable. It is still a further objective of the present invention that the unit be simple to erect and collapsible for transport and storage. Finally, it is an objective of the invention that the co-sleeper design consider and address all possible safety considerations related to its use. Other features and advantages of the invention will be seen from the following description and drawings. The present invention addresses many of the deficiencies of prior art convertible sleeping unit inventions and satisfies all of the objectives described above.

SUMMARY OF THE INVENTION

A multi-purpose convertible play yard convertibly adapted for use as a bassinet, changing table or bedside co-sleeper providing the desired features may be constructed from the following components. A rigid first enclosure is provided. The first enclosure has an open top, a floor, a front wall, a back wall, a first side wall and a second side wall. The first enclosure is of a first predetermined height. Means are provided for reversibly lowering the height of at least a portion of the front wall, from a first position at the top to a second position below the top, while maintaining structural rigidity of the play yard.

A second enclosure is provided. The second enclosure is sized to fit substantially within the first enclosure and has an open top, a back wall, a front wall, first and second side walls and a bottom. Means are provided for removably supporting the second enclosure within the first enclosure at least one predetermined distance from the top of the first enclosure. A securing strap assembly is provided for securing the play yard to a parental bed. When the front wall is in the raised first position and the second enclosure is supported by the supporting means, the play yard is usable as a bassinet. When the front wall is then lowered to the second position, the play yard is usable as a changing table. Further, when the securing strap assembly is properly positioned and the play yard is secured to the parental bed the play yard may serve as a co-sleeper.

In a variant of the invention, a rigid frame is provided. The rigid frame supports the floor, the front wall, the back wall, the first side wall and the second side wall of the first enclosure. The frame is formed adjacent the top by front and rear upper parallel horizontal rails orthogonally connected to first and second upper side horizontal rails. The frame is formed adjacent the floor by front and rear lower parallel horizontal rails orthogonally connected to first side and second side lower parallel horizontal rails. The upper and lower horizontal rails are orthogonally connected by a pair of front vertical rails and a pair of rear vertical rails located at ends of the horizontal rails.

The front vertical rails have an upper end, a lower end and are formed of tubing having a first inner diameter. Each of the front vertical rails has a vertically oriented slit penetrating the tubing. Each of the slits faces inwardly toward the other and extends downwardly from the upper ends of the rails for a first predetermined distance. A pair of adjusting members is provided. Each of the adjusting members is formed of a section of tubing that has an upper end and a lower end and is sized to fit slidably within the first inner diameter of the front vertical rails. Each of the adjusting members has a control tab fitted at the upper end of the section of tubing, the control tab is sized and shaped to fit slidably within one of the vertically oriented slits.

The front upper horizontal rail has first and second ends and is connected to the control tabs of the adjusting members at the first and second ends such that the control tabs slide upwardly and downwardly within the vertically oriented slits of the front vertical rails between a first upper position and a second lowered position while maintaining the structural rigidity of the frame. Means are provided for securing the adjusting members at either of the first upper position and the second lowered position. The front wall is formed of flexible material and has a top edge, a bottom edge, a first side edge and a second side edge. The front wall is attached at its top edge to the front upper horizontal rail, at its bottom edge to the front lower horizontal rail, and at its first and second side edges to the front vertical rails.

The front wall has a pair of vertical openings adjacent the first and second side edges and extending downwardly from the top edge along the vertically oriented slits of the front vertical rails for the first predetermined distance. Means are provided for reversibly closing the vertical openings in the front wall.

In a further variant, the means for securing the adjusting members at either of the first upper position and the second lowered position further includes a pair of securing holes. The securing holes extend through the front vertical rails adjacent their upper ends. A pair of through holes is provided. The through holes extend through the sections of tubing of the adjusting members. The securing holes and the through holes are of a second diameter and are aligned with one another when the front horizontal rail is in the first upper position. A pair of spring-loaded buttons is provided. The buttons are mounted within the sections of tubing of the adjusting members with the buttons extending outwardly through the through holes. The spring-loaded buttons also extend outwardly through the securing holes when the front horizontal rail is in the first upper position. When the spring-loaded buttons are depressed, the buttons will pass through the securing holes and the adjusting members will slide downwardly within the front vertical rails until the control tabs rest on a bottom edge of the vertically oriented slits in the rails, allowing the front horizontal rail to reach the second lowered position.

In another variant of the invention, the means for reversibly closing the vertical openings in the front wall are selected from the group comprising zippers, snaps, buttons, and hooking and looping members.

In still another variant, a rigid frame is provided. The rigid frame supports the floor, the front wall, the back wall, the first side wall and the second side wall of the first enclosure. The frame is formed adjacent the top by a rear upper horizontal rail orthogonally connected to first and second upper side horizontal rails. The frame is formed adjacent the floor by front and rear lower parallel horizontal rails orthogonally connected to first side and second side lower parallel horizontal rails. The upper and lower horizontal rails are orthogonally connected by first and second front vertical rails and a pair of rear vertical rails located at ends of the horizontal rails.

The front vertical rails have an upper end and a lower end. A rigid panel is provided. The rigid panel has upper and lower edges, first and second side edges and extends from the first front vertical rail to the second front vertical rail and extends downwardly from the upper end of the front vertical rails for a second predetermined distance. The rigid panel is hingedly attached at its lower edge to the first and second front vertical rails. Means are provided for removably securing the first and second side edges of the rigid panel adjacent the upper ends of the front vertical rails. The front wall is formed of flexible material and extends from a point below the lower edge of the rigid panel to the front lower horizontal rail and from the first front vertical rail to the second front vertical rail.

In yet another variant, the means for removably securing the first and second side edges of the rigid panel adjacent the upper ends of the front vertical rails includes first and second threaded orifices. The threaded orifices are located adjacent the upper ends of the first and second front vertical rails and face toward the rigid panel. First and second threaded fasteners are provided. The threaded fasteners are sized and shaped to threadedly engage the threaded orifices and are rotatably mounted to holes adjacent the upper edge and first and second side edges of the rigid panel. The holes are located to allow the threaded fasteners to removably engage the threaded orifices.

When the threaded fasteners are rotated to engage the threaded orifices, the rigid panel will be secured to the front vertical rails thereby forming a rigid enclosure with walls of equal height and when the threaded fasteners are rotated to disengage from the threaded orifices, the rigid panel will be lowered to provide a rigid enclosure having one lowered wall.

In yet a further variant, a rigid frame is provided. The rigid frame supports the floor, the front wall, the back wall, the first side wall and the second side wall of the first enclosure. The frame is formed adjacent the top by a rear upper horizontal rail orthogonally connected to first and second upper side horizontal rails. The frame is formed adjacent the floor by front and rear lower parallel horizontal rails orthogonally connected to first side and second side lower parallel horizontal rails. The upper and lower horizontal rails are orthogonally connected by first and second front vertical rails and a pair of rear vertical rails located at ends of the horizontal rails. The front vertical rails have an upper end and a lower end. An intermediate front horizontal rail is provided. The intermediate rail is orthogonally connected to the front vertical rails and is spaced downwardly from the upper ends of the vertical rails by a third predetermined distance. A rigid panel is provided. The rigid panel has upper and lower edges, first and second side edges and extends from the first front vertical rail to the second front vertical rail and extends downwardly from the upper end of the front vertical rails for a second predetermined distance. The rigid panel is hingedly attached at its lower edge to the intermediate front horizontal rail.

Means are provided for removably securing the first and second side edges of the rigid panel adjacent the upper ends of the front vertical rails. The front wall is formed of flexible material and extends from a point below the lower edge of the rigid panel to the front lower horizontal rail and from the first front vertical rail to the second front vertical rail.

In yet a further variant of the invention, the means for removably securing the first and second side edges of the rigid panel adjacent the upper ends of the front vertical rails includes first and second threaded orifices. The threaded orifices are located adjacent the upper ends of the first and second front vertical rails and face toward the rigid panel. First and second threaded fasteners are provided. The threaded fasteners are sized and shaped to threadedly engage the threaded orifices and are rotatably mounted to holes adjacent the upper edge and first and second side edges of the rigid panel. The holes are located to allow the threaded fasteners to removably engage the threaded orifices. When the threaded fasteners are rotated to engage the threaded orifices, the rigid panel will be secured to the front vertical rails thereby forming a rigid enclosure with walls of equal height and when the threaded fasteners are rotated to disengage from the threaded orifices, the rigid panel will be lowered to provide a rigid enclosure having one lowered wall.

In still another variant, a rigid frame is provided. The rigid frame supports the floor, the front wall, the back wall, the first side wall and the second side wall of the first enclosure. The frame is formed adjacent the top by a rear upper horizontal rail orthogonally connected to first and second upper side horizontal rails. The frame is formed adjacent the floor by front and rear lower parallel horizontal rails orthogonally connected to first side and second side lower parallel horizontal rails. The upper and lower horizontal rails are orthogonally connected by first and second front vertical rails and a pair of rear vertical rails located at ends of the horizontal rails. The front vertical rails have an upper end and a lower end.

An intermediate front horizontal rail is provided. The intermediate rail is orthogonally connected to the front vertical rails and is spaced downwardly from the upper ends of the vertical rails by a third predetermined distance. A rigid panel is provided. The rigid panel has upper and lower edges, first and second side edges and extends from the first front vertical rail to the second front vertical rail and extending downwardly from the upper end of the front vertical rails for a second predetermined distance. Means are provided for removably attaching the rigid panel to the front vertical rails. The front wall is formed of flexible material and extending from a point below the lower edge of the rigid panel to the front lower horizontal rail and from the first front vertical rail to the second front vertical rail.

In still a further variant, the means for removably securing the rigid panel to the front vertical rails includes at least two threaded orifices. The threaded orifices are located upon the first and second front vertical rails and face toward the rigid panel. At least two threaded fasteners are provided. The threaded fasteners are sized and shaped to threadedly engage the threaded orifices and are rotatably mounted to holes adjacent the first and second side edges of the rigid panel. The holes are located to allow the threaded fasteners to removably engage the threaded orifices. When the threaded fasteners are rotated to engage the threaded orifices, the rigid panel will be secured to the front vertical rails thereby forming a rigid enclosure with walls of equal height and when the threaded fasteners are rotated to disengage from the threaded orifices, the rigid panel will be removed to provide a rigid enclosure having one lowered wall.

In yet a further variant of the invention, a rigid frame is provided. The rigid frame supports the floor, the front wall, the back wall, the first side wall and the second side wall of the first enclosure. The frame is formed adjacent the top by a rear upper horizontal rail orthogonally connected to first and second upper side horizontal rails. The frame is formed adjacent the floor by front and rear lower parallel horizontal rails orthogonally connected to first side and second side lower parallel horizontal rails. The upper and lower horizontal rails are orthogonally connected by first and second front vertical rails and a pair of rear vertical rails located at ends of the horizontal rails.

The front vertical rails have an upper end and a lower end. First and second receiving tracks are provided. The receiving tracks are located upon the first and second front vertical rails and face inwardly toward each other. The receiving tracks extend from the upper ends of the front vertical rails downwardly for a fourth predetermined distance. A rigid panel is provided. The rigid panel has upper and lower edges, first and second side edges and extends from the first front vertical rail to the second front vertical rail. The rigid panel extends downwardly from the upper ends of the front vertical rails for a second predetermined distance. The rigid panel is sized and shaped to fit slidably between the first and second receiving tracks. Means are provided for maintaining the rigid panel at a first upper position, with the upper edge of the panel adjacent the upper ends of the front vertical rails.

The front wall is formed of flexible material and extends from a point below the lower edge of the rigid panel to the front lower horizontal rail and from the first front vertical rail to the second front vertical rail.

In another variant, the means for maintaining the rigid panel at the first upper position, with the upper edge of the panel adjacent the upper ends of the front vertical rails includes a pair of retaining holes. The retaining holes penetrate the first and second side edges of the rigid panel. A pair of clearance holes is provided. The clearance holes penetrate the receiving tracks so as to align with the retaining holes in the rigid panel when the panel is located in a first upper position with its upper edge adjacent the upper ends of the front vertical rails. A pair of spring-loaded pins is provided. The pins are located upon the first and second receiving tracks so that the pins will engage the retaining holes when the rigid panel is in the first upper position. When the spring-loaded pins are retracted, the rigid panel will fall in the receiving tracks to a second, lowered position.

In yet another variant, a rigid frame is provided. The rigid frame supports the floor, the front wall, the back wall, the first side wall and the second side wall of the first enclosure. The frame is formed adjacent the top by a rear upper horizontal rail orthogonally connected to first and second upper side horizontal rails. The frame is formed adjacent the floor by front and rear lower parallel horizontal rails orthogonally connected to first side and second side lower parallel horizontal rails. The upper and lower horizontal rails are orthogonally connected by first and second front vertical rails and a pair of rear vertical rails located at ends of the horizontal rails. The front vertical rails have an upper end and a lower end.

An intermediate front horizontal rail is provided. The intermediate rail is orthogonally connected to the front vertical rails and is spaced downwardly from the upper ends of the vertical rails by a third predetermined distance. Third and fourth receiving tracks are provided. The receiving tracks are located upon the first and second front vertical rails and face inwardly toward each other. The receiving tracks extend from the upper ends of the front vertical rails downwardly for a fifth predetermined distance.

A rigid panel is provided. The rigid panel has upper and lower edges, first and second side edges and extends from the first front vertical rail to the second front vertical rail and the rigid panel extends downwardly from the upper end of the front vertical rails for a second predetermined distance. The rigid panel is sized and shaped to fit slidably and removably between the third and fourth receiving tracks. The front wall is formed of flexible material and extends from a point below the lower edge of the rigid panel to the front lower horizontal rail and from the first front vertical rail to the second front vertical rail. The rigid panel extends the front wall to the upper ends of the front vertical rails.

When the rigid panel is removed from the third and fourth receiving tracks, the play yard will have a lowered front wall and be suitable for use as either of a changing table and a co-sleeper and when the rigid panel is installed between the tracks, all of the walls of the play yard will be of similar height and be suitable for use as a play yard or bassinet.

In still another variant, a rigid frame is provided. The rigid frame supports the floor, the front wall, the back wall, the first side wall and the second side wall of the first enclosure. The frame is formed adjacent the top by a rear upper horizontal rail orthogonally connected to first and second upper side horizontal rails. The frame is formed adjacent the floor by front and rear lower parallel horizontal rails orthogonally connected to first side and second side lower parallel horizontal rails. The upper and lower horizontal rails are orthogonally connected by first and second front vertical rails and a pair of rear vertical rails located at ends of the horizontal rails. The front vertical rails have an upper end and a lower end. An intermediate front horizontal rail is provided. The intermediate rail is orthogonally connected to the front vertical rails and is spaced downwardly from the upper ends of the front vertical rails by a third predetermined distance.

At least one pair of tubular receivers is provided. The receivers are affixed to the front wall. A rigid panel is provided. The rigid panel has upper and lower edges, first and second side edges and extends from the first front vertical rail to the second front vertical rail and the rigid panel extends downwardly from the upper end of the front vertical rails for a second predetermined distance. First and second securing rods are provided. The securing rods extend downwardly from the lower edge of the rigid panel. The securing rods are sized, shaped and located to fit slidably within the receivers such that the upper edge of the rigid panel will be positioned at the upper end of the front vertical rails when the securing rods are positioned within the receivers. When the securing rods are removed from the receivers, the play yard will have a lowered front wall and be suitable for use as either of a changing table and a co-sleeper and when the securing rods are installed in the receivers securing the rigid panel in place, all of the walls of the play yard will be of similar height and be suitable for use as a play yard or bassinet.

In yet another variant, means are provided for removably securing the rigid panel to the play yard.

In a further variant of the invention, the means for removably securing the rigid panel to the play yard further includes at least two threaded orifices. The threaded orifices are located upon the first and second front vertical rails and face toward the rigid panel. At least two threaded fasteners are provided. The threaded fasteners are sized and shaped to threadedly engage the threaded orifices and are rotatably mounted to holes adjacent the first and second side edges of the rigid panel. The holes are located to allow the threaded fasteners to removably engage the threaded orifices. When the threaded fasteners are rotated to engage the threaded orifices, the rigid panel will be secured to the front vertical rails thereby forming a rigid first enclosure with walls of equal height and when the threaded fasteners are rotated to disengage from the threaded orifices, the rigid panel will be removed to provide a rigid first enclosure having one lowered wall.

In still a further variant, a rigid frame is provided. The rigid frame supports the floor, the front wall, the back wall, the first side wall and the second side wall of the first enclosure. The frame is formed adjacent the top by a rear upper horizontal rail orthogonally connected to first and second upper side horizontal rails. The frame is formed adjacent the floor by front and rear lower parallel horizontal rails orthogonally connected to first side and second side lower parallel horizontal rails, the upper and lower horizontal rails are orthogonally connected by first and second front vertical rails and a pair of rear vertical rails located at ends of the horizontal rails. The front vertical rails have an upper end and a lower end.

An intermediate front horizontal rail is provided. The intermediate rail is orthogonally connected to the front vertical rails and is spaced downwardly from the upper ends of the vertical rails by a third predetermined distance. A flexible panel is provided. The flexible panel has upper and lower edges, first and second side edges and extends from the first front vertical rail to the second front vertical rail and the flexible panel extends downwardly from the upper ends of the front vertical rails for a second predetermined distance. The flexible panel is hingedly attached to the intermediate front horizontal rail at its lower edge. Means are provided for removably securing the upper edge of the flexible panel to either of the upper ends of the vertical rails and the first and second side walls.

Means are provided for reversibly attaching the first and second side edges of the flexible panel to the first and second side walls so as to eliminate any openings between the flexible panel and the side walls. When the flexible panel is secured to either of the upper ends of the vertical rails and the first and second side walls, all of the walls of the play yard will be of similar height and be suitable for use as a play yard or bassinet. When the flexible panel is detached from either of the upper ends of the vertical rails and the first and second side walls, the play yard will have a lowered front wall and be suitable for use as either of a changing table and a co-sleeper.

In yet a further variant, the means for removably securing the upper edge of the flexible panel to either of the upper ends of the vertical rails and the first and second side walls is selected from the group comprising straps with hooking and looping means, straps with adjusting buckles and straps with snaps.

In another variant of the invention, the means for reversibly attaching the first and second side edges of the flexible panel to the first and second side walls is selected from the group comprising hooking and looping means, zippers and snaps.

In still another variant, a rigid frame is provided. The rigid frame supports the floor, the front wall, the back wall, the first side wall and the second side wall of the first enclosure. The frame is formed adjacent the top by front and rear upper parallel horizontal rails orthogonally connected to first and second upper side horizontal rails. The frame is formed adjacent the floor by front and rear lower parallel horizontal rails orthogonally connected to first side and second side lower parallel horizontal rails, the upper and lower horizontal rails are orthogonally connected by first and second front vertical rails and a pair of rear vertical rails located at ends of the horizontal rails. The front vertical rails have an upper end and a lower end.

The front upper horizontal rail is removably attached to either of the upper ends of the front vertical rails and intermediate points on the front vertical rails. The intermediate points are spaced downwardly from the upper ends of the front vertical rails by a second predetermined distance. A flexible panel is provided. The flexible panel has upper and lower edges, first and second side edges and extends from the first front vertical rail to the second front vertical rail and the flexible panel extends downwardly from the upper end of the front vertical rails for the second predetermined distance. The flexible panel is attached at its upper edge to the front upper horizontal rail and attached at its lower edge to an upper edge of the front wall. Means are provided for reversibly attaching the first and second side edges of the flexible panel to the first and second side walls so as to eliminate any openings between the flexible panel and the side walls.

When the front upper horizontal rail and attached flexible panel are secured to the upper ends of the vertical rails all of the walls of the play yard will be of similar height and be suitable for use as a play yard or bassinet and when the front upper horizontal rail and attached flexible panel are attached to the intermediate points, the play yard will have a lowered front wall and be suitable for use as either of a changing table and a co-sleeper.

In yet another variant, the front upper horizontal rail includes first and second tubular members. The tubular members are sealed at their outer ends, are sized and shaped to fit slidably within one another and having a combined length greater than the front upper horizontal rail. A compression spring is provided. The spring is located within the tubular members and urges the outer ends apart from one another. First and second upper sockets are provided. The upper sockets are located at the upper ends of the front vertical rails and are sized and shaped to slidably receive the outer ends of the first and second tubular members. First and second intermediate sockets are provided. The intermediate sockets are located at the intermediate points of the front vertical rails and are sized and shaped to slidably receive the outer ends of the first and second tubular members.

When the first and second tubular members are urged toward one another, compressing the spring, the outer ends of the members will be withdrawn from the upper or intermediate sockets and the front upper horizontal rail will be movable to a raised or a lowered position. When the first and second tubular members are released, the spring will seat the outer ends of the members in the upper or intermediate sockets, thereby adjusting a height of the front wall of the play yard.

In a further variant of the invention, the means for reversibly attaching the first and second side edges of the flexible panel to the first and second side walls is selected from the group comprising hooking and looping means, zippers and snaps.

In yet a further variant, a rigid frame is provided. The rigid frame supports the floor, the front wall, the back wall, the first side wall and the second side wall of the first enclosure. The frame is formed adjacent the top by a rear upper horizontal rail orthogonally connected to first and second upper side horizontal rails. The frame is formed adjacent the floor by front and rear lower parallel horizontal rails orthogonally connected to first side and second side lower parallel horizontal rails. The upper and lower horizontal rails are orthogonally connected by first and second front vertical rails and a pair of rear vertical rails located at ends of the horizontal rails. The front vertical rails have an upper end and a lower end.

An intermediate front horizontal rail is provided. The intermediate rail is orthogonally connected to the front vertical rails and is spaced downwardly from the upper ends of the front vertical rails by a third predetermined distance. A rigid panel is provided. The rigid panel has upper and lower edges, first and second side edges and extends from the first front vertical rail to the second front vertical rail and the rigid panel extends downwardly from the upper ends of the front vertical rails for a second predetermined distance. First and second positioning arms are provided. The positioning arms have first and second ends, are pivotally mounted at their first ends to the first and second upper side horizontal rails and are pivotally mounted at their second ends to the first and second side edges of the rigid panel.

The rigid panel is movable from a first, lowered position where the upper edge of the rigid panel is located adjacent the upper ends of the front vertical rails, to a second, raised position wherein the upper edge of the rigid panel is located adjacent the rear upper horizontal rail. Means are provided for securing the rigid panel in either of the first and second positions. When the rigid panel is secured in the first, lowered position, all of the walls of the play yard will be of similar height and suitable for use as a play yard or bassinet and when the rigid panel is secured in the second, raised position, the play yard will have a lowered front wall and be suitable for use as either of a changing table and a co-sleeper.

In still a further variant, the means for securing the rigid panel in either of the first and second positions includes first and second threaded orifices. The first and second threaded orifices are located upon the first and second front vertical rails and face toward the rigid panel when the rigid panel is located in the first, lowered position. Third and fourth threaded orifices are provided. The third and fourth threaded orifices are located upon the first and second rear vertical rails and face toward the rigid panel when the rigid panel is located in the second, raised position. At least two threaded fasteners are provided. The threaded fasteners are sized and shaped to threadedly engage the threaded orifices and are rotatably mounted to holes adjacent the first and second side edges of the rigid panel, the holes are located to allow the threaded fasteners to removably engage the threaded orifices.

When the threaded fasteners are rotated to engage the first and second threaded orifices, the rigid panel will be secured to the front vertical rails thereby forming a rigid first enclosure with walls of equal height and when the threaded fasteners are rotated to engage the third and fourth threaded orifices, the rigid panel will be secured to the rear vertical rails thereby forming a rigid first enclosure having one lowered wall.

In another variant, at least four tensioning bars are provided. Each of the tensioning bars has first and second ends, a first predetermined diameter, a first predetermined length, and a rotating means attached to the first end. The rotating means has a handle and an attachment portion, the attachment portion having an external thread located between the handle and the tensioning bar. First and second side frames are provided. Each of the first and second side frames have parallel front and rear vertical rails, the vertical rails are orthogonally connected to upper and lower horizontal rails.

The first side frame has at least five internally threaded fixtures. Each of the internally threaded fixtures includes an orifice collinear with the internal threading.

The orifice is sized to permit passage of the first predetermined diameter of the tensioning bar. The internal threading is sized and shaped to engage the external thread of the attachment portion. The internally threaded fixtures are located upon the front and rear vertical rails of the first side frame, at upper and lower ends of the vertical rails and at a first point between the upper and lower ends of the front vertical rail. The orifices of the internally threaded fixtures are located orthogonally to the vertical rails and the horizontal rails.

The second side frame has at least five receiving sockets. Each of the receiving sockets has a closed end and is sized, shaped and located to slidably accept the second end of the tensioning bar. The receiving sockets are located upon the front and rear vertical rails of the second side frame, at upper and lower ends of the vertical rails and at a first point between the upper and lower ends of the front vertical rail. The orifices of the internally threaded fixtures are located orthogonally to the vertical rails and the horizontal rails.

First and second side walls are provided. Each of the first and second side walls is formed of flexible material and extends from the front vertical rails to the rear vertical rails and from the upper horizontal rails to the lower horizontal rails. A rear wall is provided. The rear wall is formed of flexible material and extends from the upper ends to the lower ends of the rear vertical rails. The rear wall has a length equal to the first predetermined length. A front wall is provided. The front wall is formed of flexible material and extends from the upper ends to the lower ends of the front vertical rails, the front wall having a length equal to the first predetermined length.

The front wall has an upper section and a lower section. The upper section extends from the upper ends of the front vertical rails to the first point on the front vertical rails. The lower section extends from the first point to lower ends of the front vertical rails. The upper section has an upper edge, the upper edge comprising a first passageway. The first passageway is sized and shaped to fit slidably over one of the tensioning bars. The lower section has an upper edge, the upper edge comprising a second passageway. The second passageway is sized and shaped to fit slidably over one of the tensioning bars. The tensioning bars serve to stretch the front and rear walls between the first and second side frames when the second ends are located in the receiving sockets and the external thread of the rotating means engages the internal threading of the internally threaded fixtures and the handles of the attachment portions are turned to urge the first side frame away from the second side frame.

When one of the tensioning bars is inserted into an internally threaded fixture at the upper end of the front vertical rail of the first side frame, through the first passageway and into a receiving socket at the upper end of the front vertical rail of the second side frame, the front wall will have a first height equal to the side and back walls, suitable for use as a play yard or bassinet. When one of the tensioning bars is inserted into an internally threaded fixture at the first point on the front vertical rail of the first side frame, through the second passageway and into a receiving socket at the first point on the front vertical rail of the second side frame the front wall will have a second, lowered height, suitable for use as a changing table or co-sleeper.

In still another variant, foot extension members are provided. The foot extension members are attached to the lower ends of the front and rear vertical rails.

The foot extension members serve to elevate the play yard above a ground surface.

In yet another variant, means are provided for attaching the back wall to the first and second side walls at rear edges thereof.

In a further variant, means are provided for attaching the lower section of the front wall to the first and second side walls at front edges thereof. Means are provided for removably attaching the upper section of the front wall to the first and second side walls at front edges thereof.

When one of the tensioning bars is inserted into an internally threaded fixture at the upper end of the front vertical rail of the first side frame, through the first passageway and into a receiving socket at the upper end of the front vertical rail of the second side frame and the removable attachment means is attached, the play yard will have the first height equal to the side and back walls, suitable for use as a play yard or bassinet and no side openings will be available adjacent the upper section of the front wall, and when one of the tensioning bars is inserted into an internally threaded fixture at the first point on the front vertical rail of the first side frame, through the second passageway and into a receiving socket at the first point on the front vertical rail of the second side frame and the removable attachment means is detached, the front wall will have a second, lowered height, suitable for use as a changing table or co-sleeper.

In yet a further variant of the invention, a bottom frame is provided. The bottom frame comprises front and rear lower horizontal rails orthogonally connected to first and second side lower horizontal rails. A top frame is provided. The top frame comprising a rear upper horizontal rail orthogonally connected to first and second side upper horizontal rails. Each of the upper horizontal rails has at least one securing protrusion on a downward facing surface of the rail.

A first tensioning member is provided. The first tensioning member has a first end and a second end and is pivotally mounted at the first end to the first side lower horizontal rail. A second tensioning member is provided. The second tensioning member has a first end and a second end and is pivotally mounted at the first end to the second side lower horizontal rail. A third tensioning member is provided. The third tensioning member has a first end and a second end and is pivotally mounted at the first end to the rear lower horizontal rail. A fourth tensioning member is provided. The fourth tensioning member has a first end and a second end and is pivotally mounted at the first end to the rear lower horizontal rail.

A position retaining device is provided. The position retaining device has a first end, a second end and a concave upper surface, the upper surface has a ridge. The position retaining device is attached at its first end to each of the second ends of the tensioning members. A first side wall is provided. The first side wall is formed of flexible material, has front and rear edges and extends from the first side lower horizontal rail to the first side upper horizontal rail for a first predetermined height. A second side wall is provided. The second side wall is formed of flexible material, has front and rear edges and extends from the second side lower horizontal rail to the second side upper horizontal rail for the first predetermined height.

A back wall is provided. The back wall is formed of flexible material, has first and second side edges and extends from the rear lower horizontal rail to the rear upper horizontal rail for the first predetermined height. A front wall is provided. The front wall is formed of flexible material, has a top edge, first and second side edges and extends from the front lower horizontal rail upwardly to a level of the first and second side upper horizontal rails for the first predetermined height. The front wall is attached at its first edge to the front edge of the first side wall and attached at its second edge to the front edge of the second side wall.

The front wall includes first and second lowering means. The lowering means are spaced inwardly from the first and second side edges and extend downwardly from the top edge for a first predetermined distance. The lowering means comprise a reclosable linear opening and permit the front wall to have the first predetermined height when closed and a second, lower predetermined height when opened. The first, second, third and fourth tensioning members have a first predetermined length. The first predetermined length is sufficient to stretch the first and second side walls, and back and front walls to the first predetermined height when the tensioning members are pivoted upwardly from the rear lower horizontal rail and first and second side lower horizontal rails such that the ridge on the concave upper surface of the position retaining device at the second end of each tensioning member is forced past the securing protrusion on the downward facing surface of the each of the upper horizontal rails.

In another variant, the reclosable linear opening of the lowering means is closed by means selected from the group comprising zippers, snaps, hooks, buttons and hooking and looping means.

In still another variant of the invention, foot extension members are provided.

The foot extension members are attached to undersides of either of the front and rear lower horizontal rails and the first and second side lower horizontal rails. The foot extension members serve to elevate the play yard above a ground surface.

In a further variant, means are provided for attaching the back wall to the first and second side walls at rear edges of the side walls.

In still a further variant, a front upper horizontal rail is provided. The front upper horizontal rail includes first and second tubular members. The tubular members are sealed at their outer ends, are sized and shaped to fit slidably within one another and having a combined length greater than the front upper horizontal rail. A compression spring is provided. The spring is located within the tubular members and urges the outer ends apart from one another. A passageway is provided. The passageway is located at the top edge of the front wall and is sized and shaped to fit slidably over the front upper horizontal rail. The front upper horizontal rail is located within the passageway. First and second upper sockets are provided. The upper sockets are located at outer ends of the first and second side upper horizontal rails and are sized and shaped to slidably receive the outer ends of the first and second tubular members.

First and second intermediate sockets are provided. The intermediate sockets are located at intermediate points of the first and second tensioning members and are sized and shaped to slidably receive the outer ends of the first and second tubular members. When the lowering means are opened and the first and second tubular members are urged toward one another, compressing the spring, the outer ends of the members will be withdrawn from either of the upper and intermediate sockets and the front upper horizontal rail will be movable to either of a raised and a lowered position. When the first and second tubular members are released, the spring will seat the outer ends of the members in either of the upper and intermediate sockets, the lowering means is closed for the raised position, thereby adjusting a height of the front wall of the play yard.

In yet a further variant of the invention, a bottom frame is provided. The bottom frame comprises front and rear lower horizontal rails orthogonally connected to first and second side lower horizontal rails. A top frame is provided. The top frame comprises a rear upper horizontal rail orthogonally connected to first and second side upper horizontal rails. First, second, third and fourth support members are provided. Each of the support members has an upper portion and an equal length lower portion. Each of the upper and lower portions has a first end and a second end. The upper and lower portions are joined at their second ends at a hinge. The hinge permits the upper and lower portions to rotate between zero and slightly more that 180 degrees with respect to each other.

Means are provided for controlling the rotation of the upper and lower portions about the hinge. The upper and lower portions of the first support member are pivotally mounted at their first ends to the first side upper and lower horizontal rails. The upper and lower portions of the second support member are pivotally mounted at their first ends to the second side upper and lower horizontal rails. The upper and lower portions of the third support member are pivotally mounted at their first ends to the rear upper and lower horizontal rails. The upper and lower portions of the fourth support member are pivotally mounted at their first ends to the rear upper and lower horizontal rails.

A first side wall is provided. The first side wall is formed of flexible material, has front and rear side edges and extends from the first side lower horizontal rail to the first side upper horizontal rail for a first predetermined height. A second side wall is provided. The second side wall is formed of flexible material, has front and rear side edges and extends from the second side lower horizontal rail to the second side upper horizontal rail for the first predetermined height. A back wall is provided. The back wall is formed of flexible material, has first and second side edges and extends from the rear lower horizontal rail to the rear upper horizontal rail for the first predetermined height. A front wall is provided. The front wall is formed of flexible material, has a top edge, first and second side edges and extends from the front lower horizontal rail upwardly to a level of the first and second side upper horizontal rails for the first predetermined height.

The front wall is attached at its first side edge to the front edge of the first side wall and attached at its second side edge to the front edge of the second side wall. The front wall includes first and second lowering means. The lowering means are spaced inwardly from the first and second side edges and extend downwardly from the top edge for a first predetermined distance. The lowering means comprise a reclosable linear opening and permit the front wall to have the first predetermined height when closed and a second, lower predetermined height when opened.

The first, second, third and fourth support members have a first predetermined length, the first predetermined length is sufficient to stretch the first and second side walls and back and front walls to the first predetermined height when the upper and lower portions of the support members are rotated at least 180 degrees from each other.

In another variant, the means for controlling the rotation of the upper and lower portions about the hinge further comprises a sleeve. The sleeve is sized and shaped to fit slidably over the hinge. A ledge is provided. The ledge is attached to the lower portion of the support member at a height sufficient to position the sleeve to enclose the hinge. When the sleeve is positioned on the ledge, the upper portion of the support member cannot rotate with respect to the lower portion of the support member. When the sleeve is raised above the hinge, the upper portion of the support member can rotate with respect to the lower portion of the support member, permitting the play yard to be collapsed for transport and storage.

In yet another variant, the reclosable linear opening of the lowering means is closed by means selected from the group comprising zippers, snaps, hooks, buttons and hooking and looping means.

In still another variant, foot extension members are provided. The foot extension members are attached to undersides of either of the front and rear lower horizontal rails and the first and second side lower horizontal rails. The foot extension members serve to elevate the play yard above a ground surface.

In yet another variant of the invention, means are provided for attaching the back wall to the first and second side walls at rear edges of the side walls.

In yet a further variant, a front upper horizontal rail is provided. The front upper horizontal rail comprises first and second tubular members. The tubular members are sealed at their outer ends, are sized and shaped to fit slidably within one another and have a combined length greater than the front upper horizontal rail. A compression spring is provided. The spring is located within the tubular members and urges the outer ends apart from one another. A passageway is provided. The passageway is located at the top edge of the front wall and is sized and shaped to fit slidably over the front upper horizontal rail. The front upper horizontal rail is located within the passageway.

First and second upper sockets are provided. The upper sockets are located at outer ends of the first and second side upper horizontal rails and are sized and shaped to slidably receive the outer ends of the first and second tubular members. First and second intermediate sockets are provided. The intermediate sockets are located at intermediate points of the first and second support members and are sized and shaped to slidably receive the outer ends of the first and second tubular members.

When the lowering means are opened and the first and second tubular members are urged toward one another, compressing the spring, the outer ends of the members will be withdrawn from either of the upper and intermediate sockets and the front upper horizontal rail will be movable to either of a raised and a lowered position, and when the first and second tubular members are released, the spring will seat the outer ends of the members in either of the upper and intermediate sockets, the lowering means are closed for the raised position, thereby adjusting a height of the front wall of the play yard.

DESCRIPTION OF THE DRAWINGS

FIG. 5 is a detailed perspective view of an adjusting member of the FIG. 3 embodiment, having a pair of tubing, controlling tabs, and spring-loaded buttons.

FIG. 12 is a detailed perspective view of the securing member of the FIGS. 6, 7, 8, 9, and 11 in part, having a pair or more of threaded orifices and fasteners.

FIG. 13 is a detailed perspective view of the securing member of the FIG. 10 in part, having a pair of spring-loaded pins and retaining holes.

DETAILED DESCRIPTION OF THE PREFERRED EMBODIMENT

Figure 1:
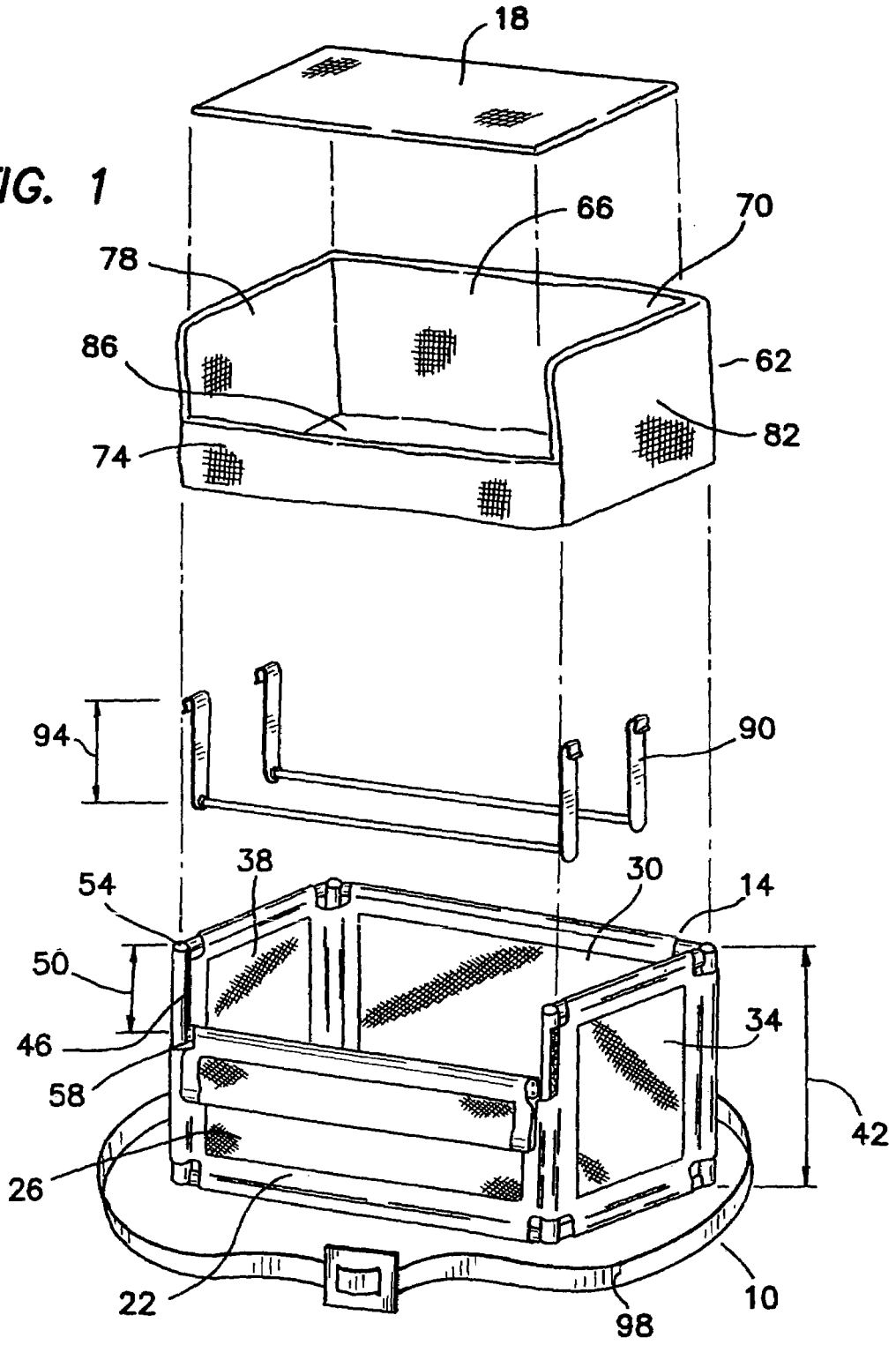
FIG. 1 is an exploded view of the preferred embodiment of the invention illustrating a multi-purpose convertible play yard convertibly adapted for use as a bassinet, changing table or bedside co-sleeper.
Figure 2:
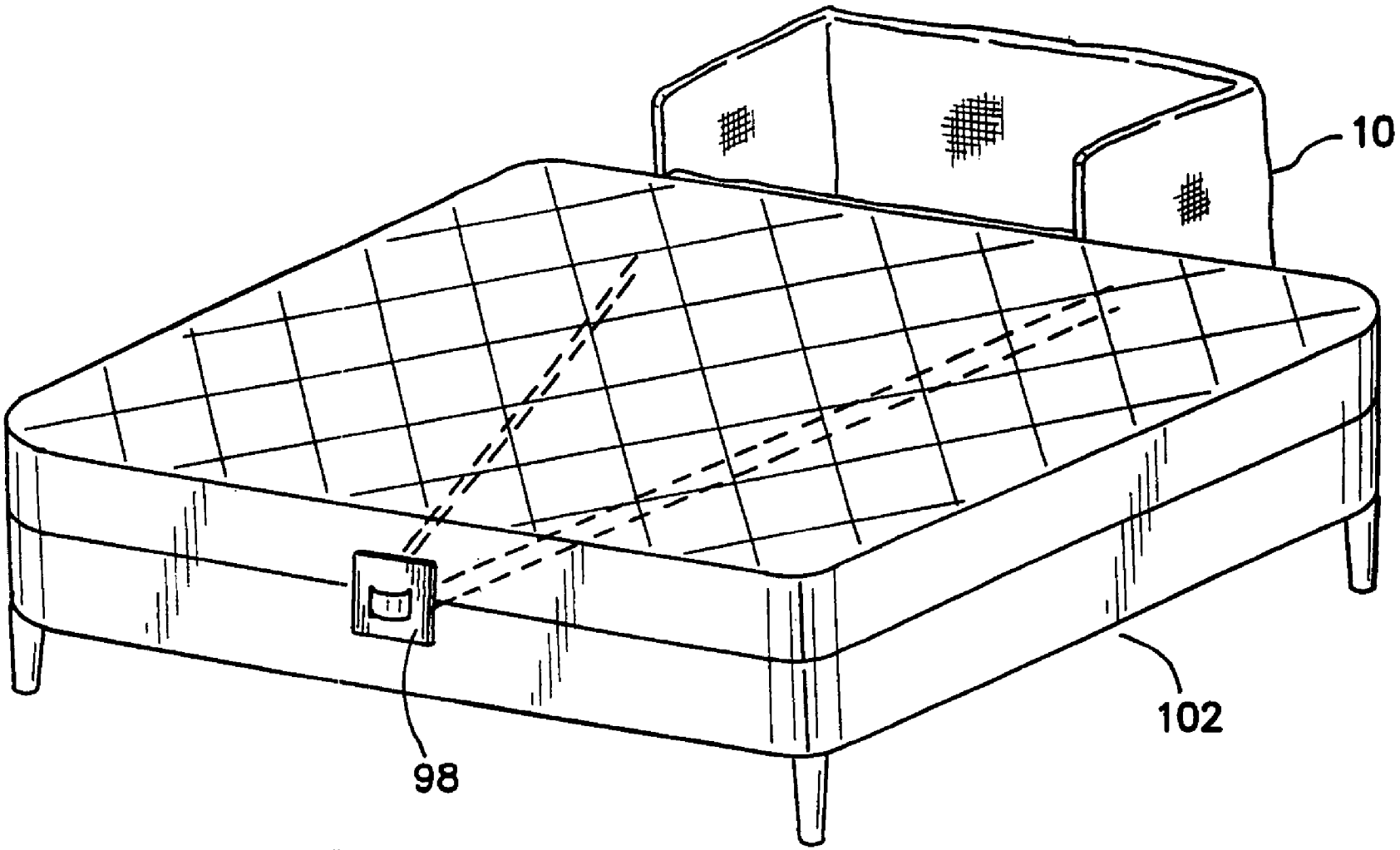
FIG. 2 is a perspective view of the FIG. 1 embodiment, illustrating the invention attached to a parental bed.

FIGS. 1–31 illustrate a multi-purpose convertible play yard 10 convertibly adapted for use as a bassinet, changing table or bedside co-sleeper providing the desired features may be constructed from the following components. As shown in FIGS. 1 and 2, a rigid first enclosure 14 is provided. The first enclosure 14 has an open top 18, a floor 22, a front wall 26, a back wall 30, a first side wall 34 and a second side wall 38. The first enclosure 14 is of a first predetermined height 42. Means 46 are provided for reversibly lowering the height of at least a portion 50 of the front wall 26, from a first position 54 at the top 18 to a second position 58 below the top 18, while maintaining structural rigidity of the play yard 10.

A second enclosure 62 is provided. The second enclosure 62 is sized to fit substantially within the first enclosure 14 and has an open top 66, a back wall 70, a front wall 74, first 78 and second 82 side walls and a bottom 86. Means 90 are provided for removably supporting the second enclosure 62 within the first enclosure 14 at at least one predetermined distance 94 from the top 18 of the first enclosure 14. A securing strap assembly 98 is provided for securing the play yard 10 to a parental bed 102. When the front wall 26 is in the raised first position 54 and the second enclosure 62 is supported by the supporting means 90, the play yard 10 is usable as a bassinet. When the front wall 26 is then lowered to the second position 58, the play yard 10 is usable as a changing table. Further, when the securing strap assembly 98 is properly positioned and the play yard 10 is secured to the parental bed 102 the play yard 10 may serve as a co-sleeper.

Figure 3:
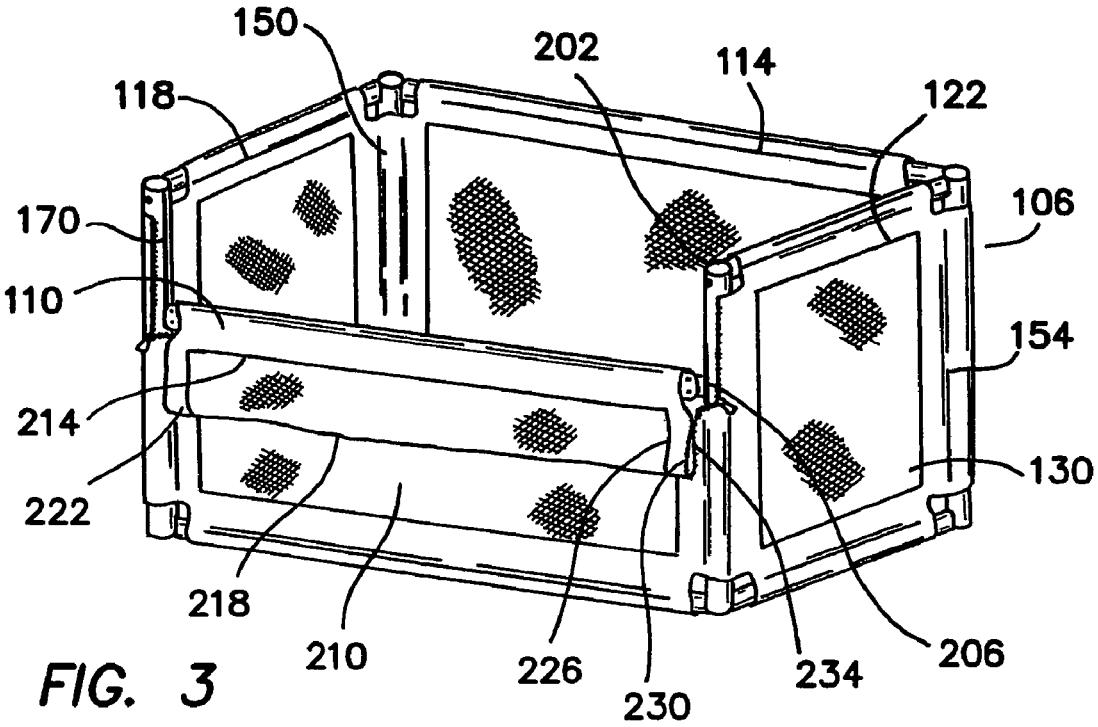
FIG. 3 is a perspective view of the preferred embodiment of FIG. 1 in part, having an adjusting member comprising a pair of tubing and control tabs.

In a variant of the invention, as shown in FIGS. 3 and 5, a rigid frame 106 is provided. The rigid frame 106 supports the floor 22, the front wall 26, the back wall 30, the first side wall 34 and the second side wall 38 of the first enclosure 14. The frame 106 is formed adjacent the top 18 by front 110 and rear 114 upper parallel horizontal rails orthogonally connected to first 118 and second 122 upper side horizontal rails. The frame 106 is formed adjacent the floor 22 by front 126 and rear 130 lower parallel horizontal rails orthogonally connected to first side 134 and second side 138 lower parallel horizontal rails. The upper 110, 114, 118, 122 and lower 126, 130, 134, 138 horizontal rails are orthogonally connected by a pair of front vertical rails 142, 146 and a pair of rear vertical rails 150, 154 located at ends of the horizontal rails 110, 114, 118, 122, 126, 130, 134, 138.

The front vertical rails 142, 146 have an upper end 158, a lower end 162 and are formed of tubing having a first inner diameter 166. Each the front vertical rails 142, 146 has a vertically oriented slit 170 penetrating the tubing. Each of the slits 170 faces inwardly toward the other and extends downwardly from the upper ends 158 of the rails 142, 146 for a first predetermined distance 174. A pair of adjusting members 178 is provided. Each of the adjusting members 178 is formed of a section of tubing 180 that has an upper end 182 and a lower end 186 and is sized to fit slidably within the first inner diameter 166 of the front vertical rails 142, 146. Each of the adjusting members 178 has a control tab 190 fitted at the upper end 182 of the section of tubing, the control tab 190 is sized and shaped to fit slidably within one of the vertically oriented slits 170.

The front upper horizontal rail 110 has first 194 and second 198 ends and is connected to the control tabs 190 of the adjusting members 178 at the first 194 and second 198 ends such that the control tabs 190 slide upwardly and downwardly within the vertically oriented slits 170 of the front vertical rails 142, 146 between a first upper position 202 and a second lowered position 206 while maintaining the structural rigidity of the frame 106. Means 212 are provided for securing the adjusting members 178 at either of the first upper position 202 and the second lowered position 206. The front wall 26 is formed of flexible material 210 and has a top edge 214, a bottom edge 218, a first side edge 222 and a second side edge 226. The front wall 26 is attached at its top edge 214 to the front upper horizontal rail 110, at its bottom edge 218 to the front lower horizontal rail 126, and at its first 222 and second 226 side edges to the front vertical rails 142, 146.

The front wall 26 has a pair of vertical openings 230 adjacent the first 222 and second 226 side edges and extending downwardly from the top edge 214 along the vertically oriented slits 170 of the front vertical rails 142, 146 for the first predetermined distance 174. Means 234 are provided for reversibly closing the vertical openings 230 in the front wall 26.

Figure 4:
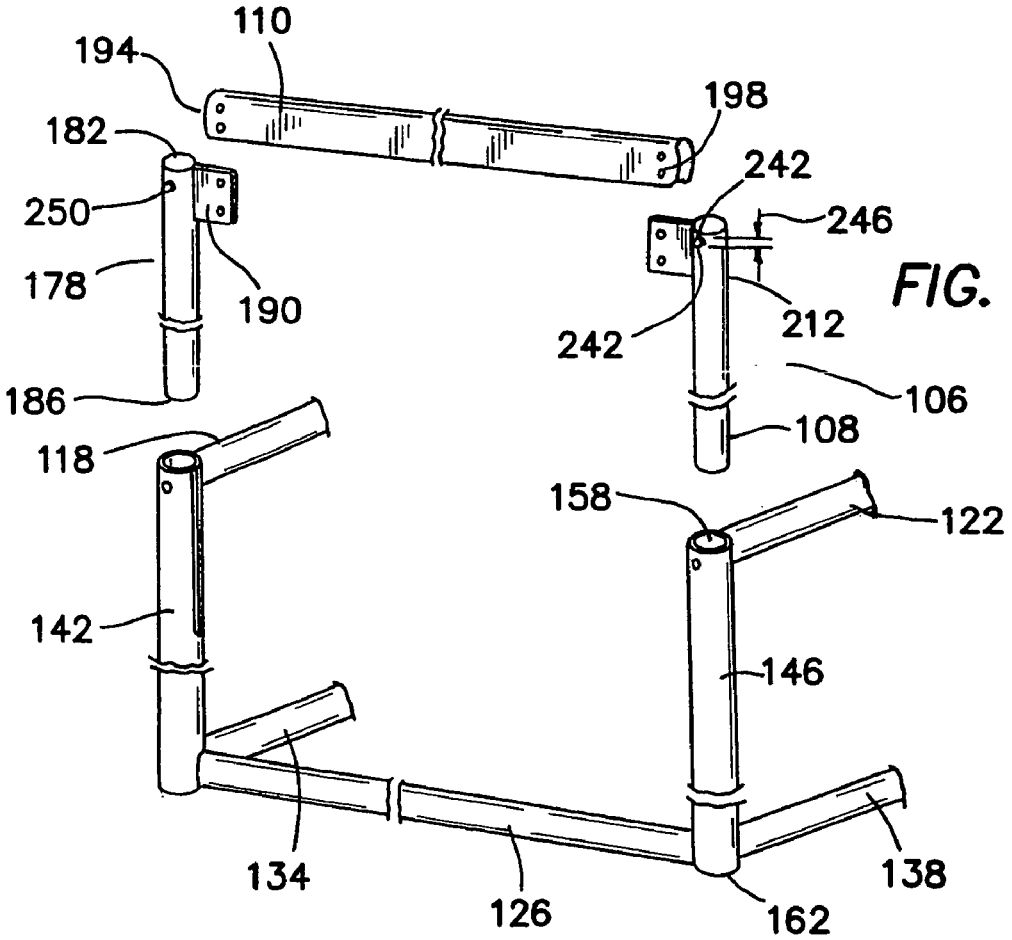
FIG. 4 is a detailed perspective view of the frame of the FIG. 3 embodiment.

In a further variant, as shown in FIG. 4, the means 212 for securing the adjusting members 178 at either of the first upper position 202 and the second lowered position 206 further includes a pair of securing holes 238. The securing holes 238 extend through the front vertical rails 142, 146 adjacent their upper ends 158. A pair of through holes 242 is provided. The through holes 242 extend through the sections of tubing 180 of the adjusting members 178. The securing holes 238 and the through holes 242 are of a second diameter 246 and are aligned with one another when the front horizontal rail 110 is in the first upper position 202. A pair of spring-loaded buttons 250 is provided. The buttons 250 are mounted within the sections of tubing 180 of the adjusting members 178 with the buttons 250 extending outwardly through the through holes 242. The spring-loaded buttons 250 also extend outwardly through the securing holes 238 when the front horizontal rail 110 is in the first upper position 202. When the spring-loaded buttons 250 are depressed, the buttons 250 will pass through the securing holes 238 and the adjusting members 178 will slide downwardly within the front vertical rails 142, 146 until the control tabs 190 rest on a bottom edge 254 of the vertically oriented slits 170 in the rails 142, 146, allowing the front horizontal rail 110 to reach the second lowered position 206.

In another variant of the invention, as shown in FIG. 4, the means 234 for reversibly closing the vertical openings in the front wall are selected from the group comprising zippers 258, snaps (not shown), buttons (not shown), and hooking and looping members (not shown).

Figure 6:
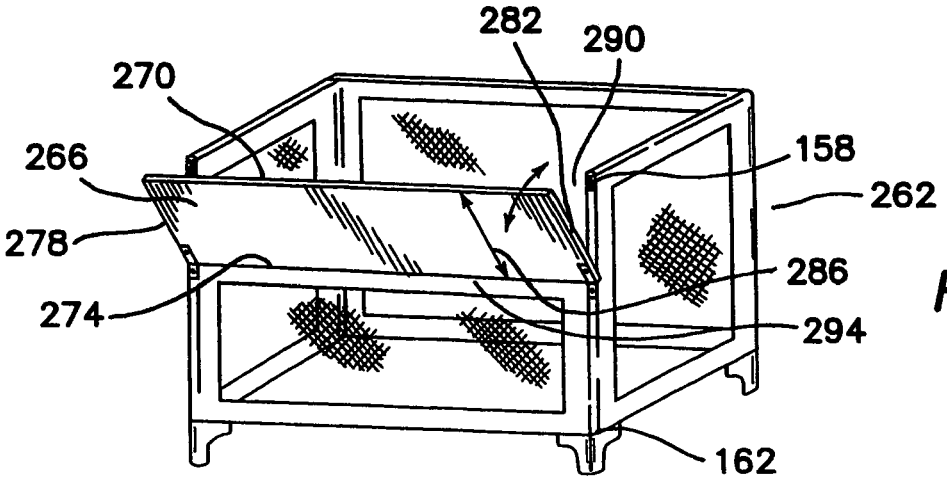
FIG. 6 is a perspective view of a second embodiment of the invention, wherein a rigid front panel is hingedly attached to front vertical rails.

In still another variant, as shown in FIG. 6, a rigid frame 262 is provided. The rigid frame 262 supports the floor 22, the front wall 26, the back wall 30, the first side wall 34 and the second side wall 38 of the first enclosure 14. The frame 262 is formed adjacent the top 18 by a rear upper (parallel) horizontal rail 114 orthogonally connected to first 118 and second 122 upper side horizontal rails. The frame 262 is formed adjacent the floor 22 by front 126 and rear 130 lower parallel horizontal rails orthogonally connected to first side 134 and second side 138 lower parallel horizontal rails. The upper 114, 118, 122 and lower 126, 130, 134, 138 horizontal rails are orthogonally connected by first 142 and second 146 front vertical rails and a pair of rear vertical rails 150, 154 located at ends of the horizontal rails 114, 118, 122, 126, 130, 134, 138.

The front vertical rails 142, 146 have an upper end 158 and a lower end 162. A rigid panel 266 is provided. The rigid panel 266 has upper 270 and lower 274 edges, first 278 and second 282 side edges and extends from the first front vertical rail 142 to the second front vertical rail 146 and extends downwardly from the upper end 270 of the front vertical rails 142, 146 for a second predetermined distance 286. The rigid panel 266 is hingedly attached at its lower edge 274 to the first 142 and second 146 front vertical rails. Means 290 are provided for removably securing the first 278 and second 282 side edges of the rigid panel 266 adjacent the upper ends 158 of the front vertical rails 142, 146. The front wall 26 is formed of flexible material 210 and extends from a point 294 below the lower edge 274 of the rigid panel 266 to the front lower horizontal rail 126 and from the first front vertical rail 142 to the second front vertical rail 146.

In yet another variant, as shown in FIGS. 12 and 13, the means 290 for removably securing the first 278 and second 282 side edges of the rigid panel 266 adjacent the upper ends 158 of the front vertical rails 142, 146 includes first 298 and second 302 threaded orifices. The threaded orifices 298, 302 are located adjacent the upper ends 158 of the first 142 and second 146 front vertical rails and face toward the rigid panel 266. First 306 and second 310 threaded fasteners are provided. The threaded fasteners 306, 310 are sized and shaped to threadedly engage the threaded orifices 298, 302 and are rotatably mounted to holes 314 adjacent the upper edge 270 and first 278 and second 282 side edges of the rigid panel 266. The holes 314 are located to allow the threaded fasteners 306, 310 to removably engage the threaded orifices 298, 302. When the threaded fasteners 306, 310 are rotated to engage the threaded orifices 298, 302, the rigid panel 266 will be secured to the front vertical rails 142, 146 thereby forming a rigid enclosure 14 with walls 26, 30, 34, 38 of equal height and when the threaded fasteners 306, 310 are rotated to disengage from the threaded orifices 298, 302, the rigid panel 266 will be lowered to provide a rigid enclosure 14 having one lowered wall 26.

Figure 7:
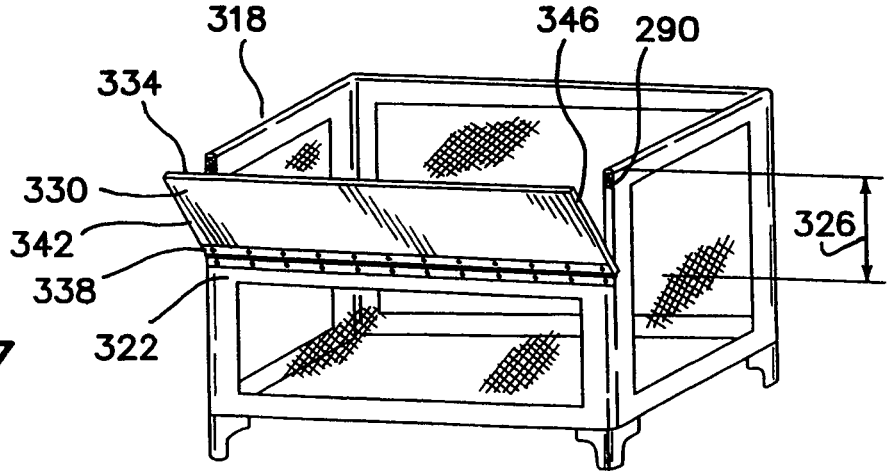
FIG. 7 is a perspective view of a third embodiment of the invention similar to the FIG. 6, wherein a rigid front panel is hingedly attached to the intermediate front horizontal rail.

In yet a further variant, as shown in FIG. 7, a rigid frame 318 is provided. The rigid frame 318 supports the floor 22, the front wall 26, the back wall 30, the first side wall 34 and the second side wall 38 of the first enclosure 14. The frame 318 is formed adjacent the top 18 by a rear upper horizontal rail 114 orthogonally connected to first 118 and second 122 upper side horizontal rails. The frame 318 is formed adjacent the floor 22 by front 126 and rear 130 lower parallel horizontal rails orthogonally connected to first side 134 and second side 138 lower parallel horizontal rails. The upper 114 and lower 126, 130 horizontal rails are orthogonally connected by first 142 and second 146 front vertical rails and a pair of rear vertical rails 150, 154 located at ends of the horizontal rails 114, 118, 122, 126, 130, 134, 138. The front vertical rails 142, 146 have an upper end 158 and a lower end 162. An intermediate front horizontal rail 322 is provided. The intermediate rail 322 is orthogonally connected to the front vertical rails 142, 146 and is spaced downwardly from the upper ends 158 of the vertical rails 142, 146 by a third predetermined distance 326. A rigid panel 330 is provided. The rigid panel 330 has upper 334 and lower 338 edges, first 342 and second 346 side edges and extends from the first front vertical rail 142 to the second front vertical rail 146 and extends downwardly from the upper ends 158 of the front vertical rails 142, 146 for a second predetermined distance 286. The rigid panel 330 is hingedly attached at its lower edge 338 to the intermediate front horizontal rail 322.

Means 290 are provided for removably securing the first 342 and second 346 side edges of the rigid panel 330 adjacent the upper ends 158 of the front vertical rails 142, 146. The front wall 26 is formed of flexible material 210 and extends from a point 294 below the lower edge 338 of the rigid panel 330 to the front lower horizontal rail 126 and from the first 142 front vertical rail to the second front vertical rail 146.

In yet a further variant of the invention, as shown in FIGS. 12 and 13, the means 290 for removably securing the first 278 and second 282 side edges of the rigid panel 266 adjacent the upper ends 158 of the front vertical rails 142, 146 includes first 298 and second 302 threaded orifices. The threaded orifices 298, 302 are located adjacent the upper ends 158 of the first 142 and second 146 front vertical rails and face toward the rigid panel 266. First 306 and second 310 threaded fasteners are provided. The threaded fasteners 306, 310 are sized and shaped to threadedly engage the threaded orifices 298, 302 and are rotatably mounted to holes 314 adjacent the upper edge 270 and first 278 and second 282 side edges of the rigid panel 266. The holes 314 are located to allow the threaded fasteners 306, 310 to removably engage the threaded orifices 298, 302. When the threaded fasteners 306, 310 are rotated to engage the threaded orifices 298, 302, the rigid panel 266 will be secured to the front vertical rails 142, 146 thereby forming a rigid enclosure 14 with walls 26, 30, 34, 38 of equal height and when the threaded fasteners 306, 310 are rotated to disengage from the threaded orifices 298, 302, the rigid panel 266 will be lowered to provide a rigid enclosure 14 having one lowered wall 26.

Figure 8:
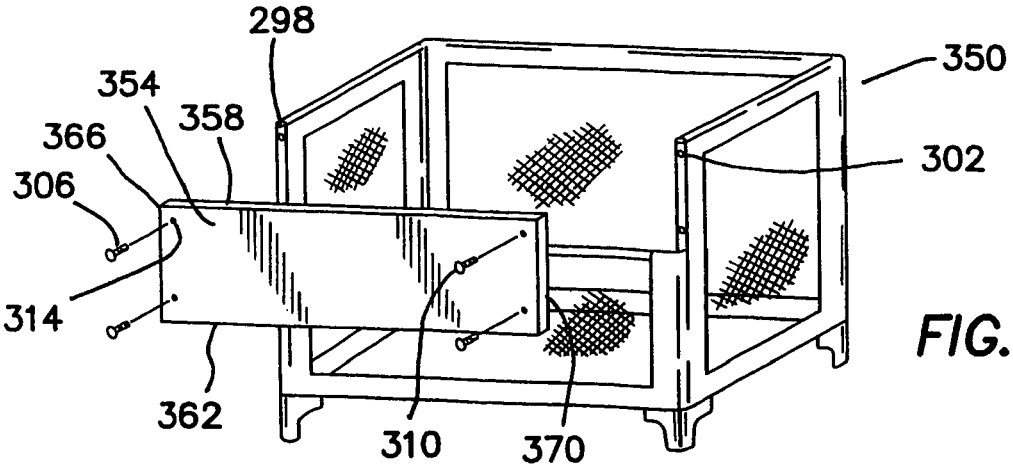
FIG. 8 is a perspective view of a fourth embodiment of the invention, wherein a rigid front panel is attached to the front vertical rails by threaded orifices and fasteners.

In still another variant, as shown in FIG. 8, a rigid frame 350 is provided. The rigid frame 350 supports the floor 22, the front wall 26, the back wall 30, the first side wall 34 and the second side wall 38 of the first enclosure 14. The frame 350 is formed adjacent the top 18 by a rear upper horizontal rail 114 orthogonally connected to first 118 and second 122 upper side horizontal rails. The frame 350 is formed adjacent the floor 22 by front 126 and rear 130 lower parallel horizontal rails orthogonally connected to first side 134 and second side 138 lower parallel horizontal rails. The upper 114, 118, 122 and lower 126, 130, 134, 138 horizontal rails are orthogonally connected by first 142 and second 146 front vertical rails and a pair of rear vertical rails 150, 154 located at ends of the horizontal rails 114, 118, 122, 126, 130, 134, 138. The front vertical rails 142, 146 have an upper end 158 and a lower end 162.

An intermediate front horizontal rail 322 is provided. The intermediate rail 322 is orthogonally connected to the front vertical rails 142, 146 and is spaced downwardly from the upper ends 158 of the vertical rails 142, 146 by a third predetermined distance 326. A rigid panel 354 is provided. The rigid panel 354 has upper 358 and lower 362 edges, first 366 and second 370 side edges and extends from the first front vertical rail 142 to the second front vertical rail 146 and extending downwardly from the upper ends 158 of the front vertical rails 142, 146 for a second predetermined distance 286. Means 290 are provided for removably attaching the rigid panel 354 to the front vertical rails 142, 146. The front wall 26 is formed of flexible material 210 and extends from a point 294 below the lower edge 362 of the rigid panel 354 to the front lower horizontal rail 126 and from the first 142 front vertical rail to the second front vertical rail 146.

In still a further variant, as shown in FIGS. 12 and 13, the means 290 for removably securing the rigid panel 354 to the front vertical rails 142, 146 includes at least two threaded orifices 298, 302, the threaded orifices 298, 302 are located upon the first 142 and second 146 front vertical rails and face toward the rigid panel 354. At least two threaded fasteners 306, 310 are provided. The threaded fasteners 306, 310 are sized and shaped to threadedly engage the threaded orifices 298, 302 and are rotatably mounted to holes 314 adjacent the first 366 and second 370 side edges of the rigid panel 354. The holes 314 are located to allow the threaded fasteners 306, 310 to removably engage the threaded orifices 298, 302. When the threaded fasteners 306, 310 are rotated to engage the threaded orifices 298, 302, the rigid panel 354 will be secured to the front vertical rails 142, 146 thereby forming a rigid enclosure 14 with walls 26, 30, 34, 38 of equal height and when the threaded fasteners 306, 310 are rotated to disengage from the threaded orifices 298, 302, the rigid panel 354 will be removed to provide a rigid enclosure 14 having one lowered wall 26.

Figure 9:
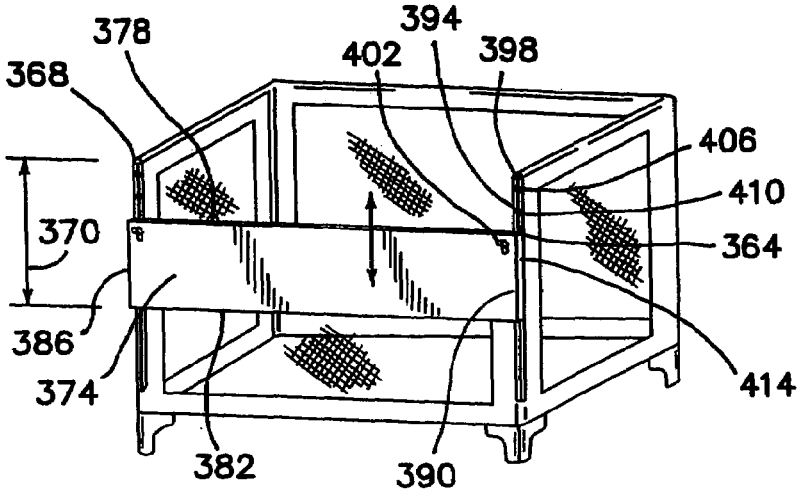
FIG. 9 is a perspective view of a fifth embodiment of the invention, having a pair of receiving tracks on the front vertical rails to receive a rigid front panel.

In yet a further variant of the invention, as shown in FIG. 9, a rigid frame 358 is provided. The rigid frame 358 supports the floor 22, the front wall 26, the back wall 30, the first side wall 34 and the second side wall 38 of the first enclosure 14. The frame 358 is formed adjacent the top 18 by a rear upper horizontal rail 114 orthogonally connected to first 118 and second 122 upper side horizontal rails. The frame 358 is formed adjacent the floor 22 by front 126 and rear 130 lower parallel horizontal rails orthogonally connected to first side 134 and second side 138 lower parallel horizontal rails. The upper 114, 118, 122 and lower 126, 130, 134, 138 horizontal rails are orthogonally connected by first 142 and second 146 front vertical rails and a pair of rear vertical rails 150, 154 located at ends of the horizontal rails 114, 118, 122, 126, 130, 134, 138.

The front vertical rails 142, 146 have an upper end 158 and a lower end 162. First 364 and second 368 receiving tracks are provided. The receiving tracks 364, 368 are located upon the first 142 and second 146 front vertical rails and face inwardly toward each other. The receiving tracks 364, 368 extend from the upper ends 158 of the front vertical rails 142, 146 downwardly for a fourth predetermined distance 370. A rigid panel 374 is provided. The rigid panel 374 has upper 378 and lower 382 edges, first 386 and second 390 side edges and extends from the first front vertical rail 142 to the second front vertical rail 146. The rigid panel 374 extends downwardly from the upper ends 158 of the front vertical rails 142, 146 for a second predetermined distance 286. The rigid panel 374 is sized and shaped to fit slidably between the first 364 and second 368 receiving tracks. Means 394 are provided for maintaining the rigid panel 374 at a first upper position 398, with the upper edge 378 of the panel 374 adjacent the upper ends 158 of the front vertical rails 142, 146.

The front wall 26 is formed of flexible material 210 and extends from a point 294 below the lower edge 382 of the rigid panel 378 to the front lower horizontal rail 126 and from the first front vertical rail 142 to the second front vertical rail 146.

In another variant, as shown in FIG. 9, the means 394 for maintaining the rigid panel 374 at the first upper position 398, with the upper edge 378 of the panel 374 adjacent the upper ends 158 of the front vertical rails 142, 146 includes a pair of retaining holes 402. The retaining holes 402 penetrate the first 386 and second 390 side edges of the rigid panel 374. A pair of clearance holes 406 is provided. The clearance holes 406 penetrate the receiving tracks 364, 368 so as to align with the retaining holes 402 in the rigid panel 374 when the panel 374 is located in the first upper position 398 with its upper edge 378 adjacent the upper ends 158 of the front vertical rails 142, 146. A pair of spring-loaded pins 410 is provided. The pins 410 are located upon the first 364 and second 368 receiving tracks so that the pins 410 will engage the retaining holes 402 when the rigid panel 374 is in the first upper position 398. When the spring-loaded pins 410 are retracted, the rigid panel 374 will fall in the receiving tracks 364, 368 to a second, lowered position 414.

Figure 10:
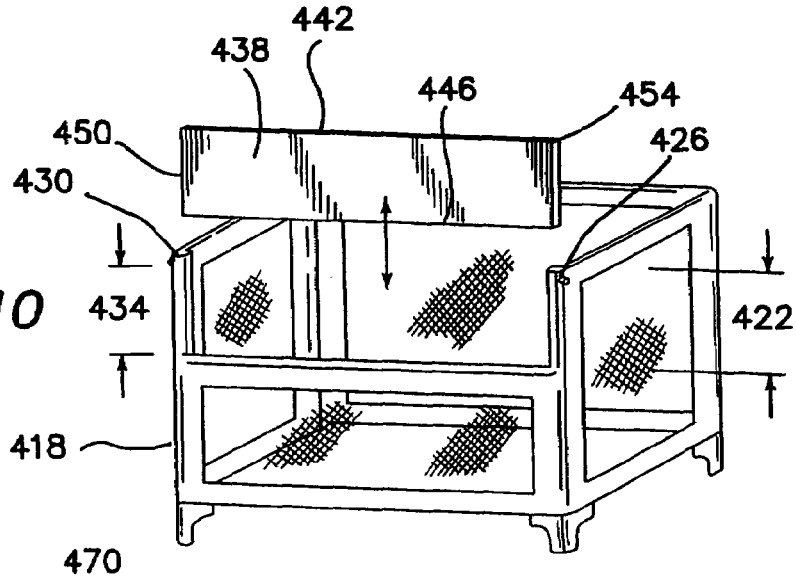
FIG. 10 is a perspective view of a sixth embodiment of the invention, similar to the FIG. 9, but having a means for maintaining a rigid front panel by a pair of spring-loaded pins and retaining holes.

In yet another variant, as shown in FIG. 10, a rigid frame 418 is provided. The rigid frame 418 supports the floor 22, the front wall 26, the back wall 30, the first side wall 34 and the second side wall 38 of the first enclosure 14. The frame 418 is formed adjacent the top 18 by a rear upper horizontal rail 114 orthogonally connected to first 118 and second 122 upper side horizontal rails. The frame 418 is formed adjacent the floor 22 by front 126 and rear 130 lower parallel horizontal rails orthogonally connected to first side 134 and second side 138 lower parallel horizontal rails. The upper 114, 118, 122 and lower 126, 130, 134, 138 horizontal rails are orthogonally connected by first 142 and second 146 front vertical rails and a pair of rear vertical rails 150, 154 located at ends of the horizontal rails 114, 118. The front vertical rails 142, 146 have an upper end 158 and a lower end 162.

An intermediate front horizontal rail 322 is provided. The intermediate rail 322 is orthogonally connected to the front vertical rails 142, 146 and is spaced downwardly from the upper ends 158 of the vertical rails 142, 146 by a third predetermined distance 422. Third 426 and fourth 430 receiving tracks are provided. The receiving tracks 426, 430 are located upon the first 142 and second 146 front vertical rails and face inwardly toward each other. The receiving tracks 426, 430 extend from the upper ends 158 of the front vertical rails 142, 146 downwardly for a fifth predetermined distance 434.

A rigid panel 438 is provided. The rigid panel 438 has upper 442 and lower 446 edges, first 450 and second 454 side edges and extends from the first front vertical rail 142 to the second front vertical rail 146 and the rigid panel 438 extends downwardly from the upper ends 158 of the front vertical rails 142, 146 for a second predetermined distance 286. The rigid panel 438 is sized and shaped to fit slidably and removably between the third 426 and fourth 430 receiving tracks. The front wall 26 is formed of flexible material 210 and extends from a point 294 below the lower edge 446 of the rigid panel 438 to the front lower horizontal rail 126 and from the first front vertical rail 142 to the second front vertical rail 146. The rigid panel 438 extends the front wall 26 to the upper ends 158 of the front vertical rails 142, 146.

When the rigid panel 438 is removed from the third 426 and fourth 430 receiving tracks, the play yard 10 will have a lowered front wall 26 and be suitable for use as either of a changing table and a co-sleeper and when the rigid panel 438 is installed between the tracks 426, 430, all of the walls 26, 30, 34, 38 of the play yard 10 will be of similar height and be suitable for use as a play yard 10 or bassinet.

Figure 11:
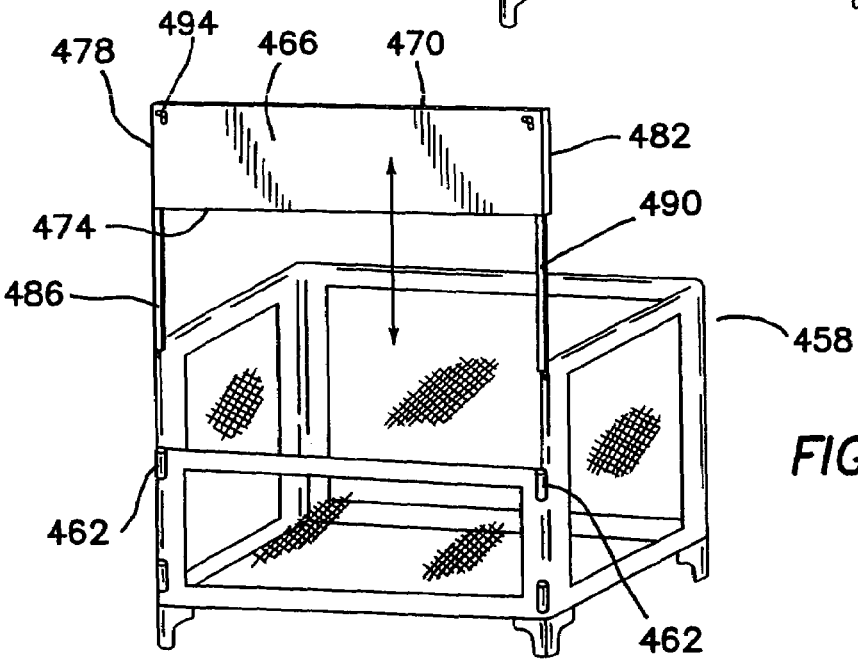
FIG. 11 is a perspective view of a seventh embodiment of the invention, having one pair of tubular receivers affixed to a front wall and a pair of securing rods attached to a front panel.

In still another variant, as shown in FIG. 11, a rigid frame 458 is provided. The rigid frame 458 supports the floor 22, the front wall 26, the back wall 30, the first side wall 34 and the second side wall 38 of the first enclosure 14. The frame 458 is formed adjacent the top 18 by a rear upper horizontal rail 114 orthogonally connected to first 118 and second 122 upper side horizontal rails. The frame 458 is formed adjacent the floor 22 by front 126 and rear 130 lower parallel horizontal rails orthogonally connected to first side 134 and second side 138 lower parallel horizontal rails. The upper 114, 118, 122 and lower 126, 130, 134, 138 horizontal rails are orthogonally connected by first 142 and second 146 front vertical rails and a pair of rear vertical rails 150, 154 located at ends of the horizontal rails 114, 118, 122, 126, 130, 134, 138. The front vertical rails 142 have an upper end 158 and a lower end 162. An intermediate front horizontal rail 322 is provided. The intermediate rail 322 is orthogonally connected to the front vertical rails 142, 146 and is spaced downwardly from the upper ends 158 of the front vertical rails 142, 146 by a third predetermined distance 422.

At least one pair of tubular receivers 462 is provided. The receivers 462 are affixed to the front wall 26. A rigid panel 466 is provided. The rigid panel 466 has upper 470 and lower 474 edges, first 478 and second 482 side edges and extends from the first front vertical rail 142 to the second front vertical rail 146 and the rigid panel 466 extends downwardly from the upper end 158 of the front vertical rails 142, 146 for a second predetermined distance 286. First 486 and second 490 securing rods are provided. The securing rods 486, 490 extend downwardly from the lower edge 474 of the rigid panel 466. The securing rods 486, 490 are sized, shaped and located to fit slidably within the receivers 462 such that the upper edge 470 of the rigid panel 466 will be positioned at the upper ends 158 of the front vertical rails 142, 146 when the securing rods 486, 490 are positioned within the receivers 462. When the securing rods 486, 490 are removed from the receivers 462, the play yard 10 will have a lowered front wall 26 and be suitable for use as either of a changing table and a co-sleeper and when the securing rods 486, 490 are installed in the receivers 462 securing the rigid panel 466 in place, all of the walls 26, 30, 34, 38 of the play yard 10 will be of similar height and be suitable for use as a play yard 10 or bassinet.

In yet another variant, as shown in FIG. 11, means 494 are provided for removably securing the rigid panel 466 to the play yard 10.

In a further variant of the invention, as shown in FIGS. 12 and 13, the means 494 for removably securing the rigid panel 466 to the play yard 10 further includes at least two threaded orifices 298, 302. The threaded orifices 298, 302 are located upon the first 142 and second 146 front vertical rails and face toward the rigid panel 466. At least two threaded fasteners 306, 310 are provided. The threaded fasteners 306, 310 are sized and shaped to threadedly engage the threaded orifices 298, 302 and are rotatably mounted to holes 314 adjacent the first 478 and second 482 side edges of the rigid panel 466. The holes 314 are located to allow the threaded fasteners 306, 310 to removably engage the threaded orifices 298, 302. When the threaded fasteners 306, 310 are rotated to engage the threaded orifices 298, 302, the rigid panel 466 will be secured to the front vertical rails 142, 146 thereby forming a rigid first enclosure 14 with walls 26, 30, 34, 38 of equal height and when the threaded fasteners 306, 310 are rotated to disengage from the threaded orifices 298, 302, the rigid panel 466 will be removed to provide a rigid first enclosure 14 having one lowered wall 26.

Figure 14:
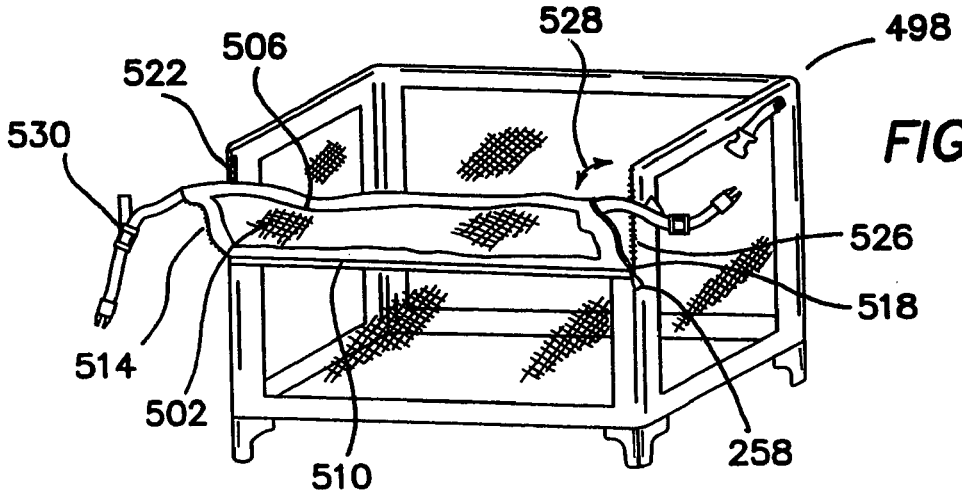
FIG. 14 is a perspective view of a eighth embodiment of the invention, wherein a flexible front panel is attached by means of straps with hooking and looping means, straps with adjusting buckles and straps with snaps, or zippers and snaps.

In still a further variant, as shown in FIG. 14, a rigid frame 498 is provided. The rigid frame 498 supports the floor 22, the front wall 26, the back wall 30, the first side wall 34 and the second side wall 38 of the first enclosure 14. The frame 498 is formed adjacent the top 18 by a rear upper horizontal rail 114 orthogonally connected to first 118 and second 122 upper side horizontal rails. The frame 498 is formed adjacent the floor 22 by front 126 and rear 130 lower parallel horizontal rails orthogonally connected to first side 134 and second side 138 lower parallel horizontal rails, the upper 114, 118, 122 and lower 126, 130, 134, 138 horizontal rails are orthogonally connected by first 142 and second 146 front vertical rails and a pair of rear vertical rails 150, 154 located at ends of the horizontal rails 114, 118, 122, 126, 130, 134, 138. The front vertical rails 142, 146 have an upper end 158 and a lower end 162.

An intermediate front horizontal rail 322 is provided. The intermediate rail 322 is orthogonally connected to the front vertical rails 142, 146 and is spaced downwardly from the upper ends 158 of the vertical rails 142, 146 by a third predetermined distance 422. A flexible panel 502 is provided. The flexible panel 502 has upper 506 and lower 510 edges, first 514 and second 518 side edges and extends from the first front vertical rail 142 to the second front vertical rail 146 and the flexible panel 502 extends downwardly from the upper ends 158 of the front vertical rails 142, 146 for a second predetermined distance 286. The flexible panel 502 is hingedly attached to the intermediate front horizontal rail 322 at its lower edge 510. Means 522 are provided for removably securing the upper edge 506 of the flexible panel 502 to either of the upper ends 158 of the vertical rails 142, 146 and the first 34 and second 38 side walls.

Means 526 are provided for reversibly attaching the first 514 and second 518 side edges of the flexible panel 502 to the first 34 and second 38 side walls so as to eliminate any openings 530 between the flexible panel 502 and the side walls 34, 38. When the flexible panel 502 is secured to either of the upper ends 158 of the vertical rails 142, 146 and the first 34 and second 38 side walls, all of the walls 26, 30, 34, 38 of the play yard 10 will be of similar height and be suitable for use as a play yard 10 or bassinet. When the flexible panel 502 is detached from either of the upper ends 158 of the vertical rails 142, 146 and the first 34 and second 38 side walls, the play yard 10 will have a lowered front wall 26 and be suitable for use as either of a changing table and a co-sleeper.

In yet a further variant, as shown in FIG. 14, the means 522 for removably securing the upper edge 506 of the flexible panel 502 to either of the upper ends 158 of the vertical rails 142, 146 and the first 34 and second 38 side walls is selected from the group comprising straps with hooking and looping means (not shown), straps with adjusting buckles 530 and straps with snaps (not shown).

In another variant of the invention, as shown in FIG. 14, the means 526 for reversibly attaching the first 514 and second 518 side edges of the flexible panel 502 to the first 34 and second 38 side walls is selected from the group comprising hooking and looping means (not shown), zippers 534 and snaps (not shown).

Figure 20:
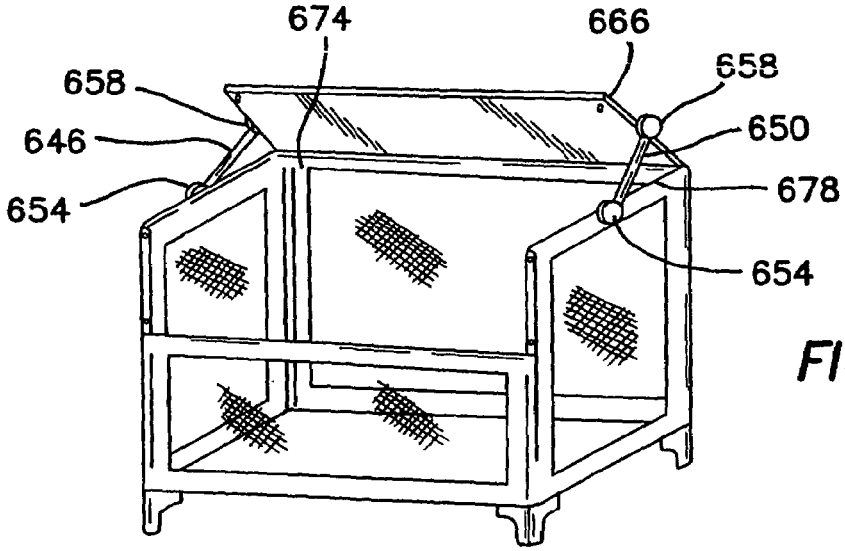
FIG. 20 is a still another perspective view of the FIG. 18 embodiment, further illustrating the securing means of the front panel at the rear horizontal rails.

In still another variant, as shown in FIG. 20, a rigid frame 538 is provided. The rigid frame 538 supports the floor 22, the front wall 26, the back wall 30, the first side wall 34 and the second side wall 38 of the first enclosure 14. The frame 538 is formed adjacent the top 18 by front 110 and rear 114 upper parallel horizontal rails orthogonally connected to first 118 and second 122 upper side horizontal rails. The frame 538 is formed adjacent the floor 22 by front 126 and rear 130 lower parallel horizontal rails orthogonally connected to first side 134 and second side 138 lower parallel horizontal rails, the upper 110, 114, 118, 122 and lower 126, 130, 134, 138 horizontal rails are orthogonally connected by first 142 and second 146 front vertical rails and a pair of rear vertical rails 150, 154 located at ends of the horizontal rails 110, 114, 118, 122, 126, 130, 134, 138. The front vertical rails have an upper end 158 and a lower end 162.

The front upper horizontal rail 110 is removably attached to either of the upper ends 158 of the front vertical rails 142, 146 and intermediate points 542 on the front vertical rails 142, 146. The intermediate points 542 are spaced downwardly from the upper ends 158 of the front vertical rails 142, 146 by a second predetermined distance 286. A flexible panel 546 is provided. The flexible panel 546 has upper 550 and lower 554 edges, first 558 and second 562 side edges and extends from the first front vertical rail 142 to the second front vertical rail 146 and the flexible panel 546 extends downwardly from the upper ends 158 of the front vertical rails 142, 146 for the second predetermined distance 286. The flexible panel 546 is attached at its upper edge 550 to the front upper horizontal rail 110 and attached at its lower edge 554 to an upper edge 566 of the front wall 26. Means 570 are provided for reversibly attaching the first 558 and second 562 side edges of the flexible panel 546 to the first 34 and second 38 side walls so as to eliminate any openings between the flexible panel 546 and the side walls 34, 38.

When the front upper horizontal rail 110 and attached flexible panel 546 are secured to the upper ends 158 of the vertical rails 142, 146 all of the walls 26, 30, 34, 38 of the play yard 10 will be of similar height and be suitable for use as a play yard 10 or bassinet and when the front upper horizontal rail 110 and attached flexible panel 546 are attached to the intermediate points 542, the play yard 10 will have a lowered front wall 26 and be suitable for use as either of a changing table and a co-sleeper.

Figure 15:
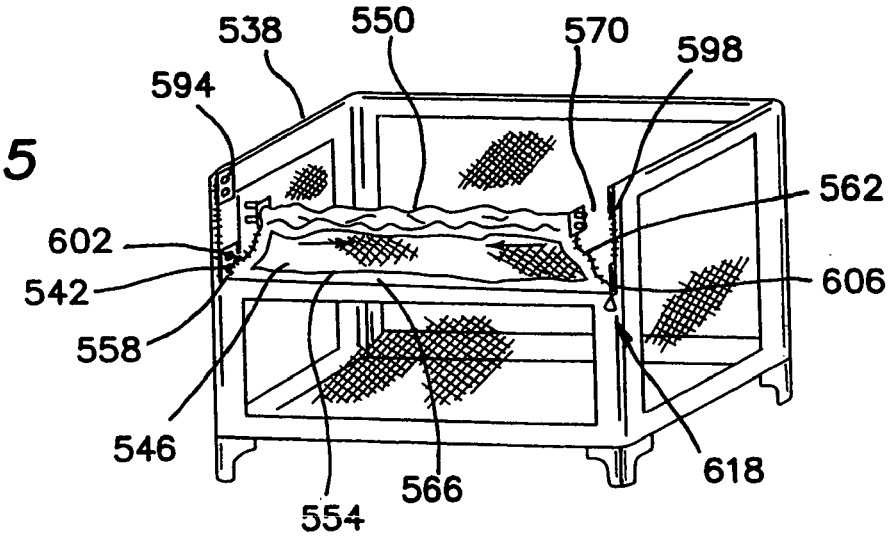
FIG. 15 is a perspective view of a ninth embodiment of the invention, wherein a flexible front panel is attached by means of tubular member having a compression spring and sockets.
Figure 17:
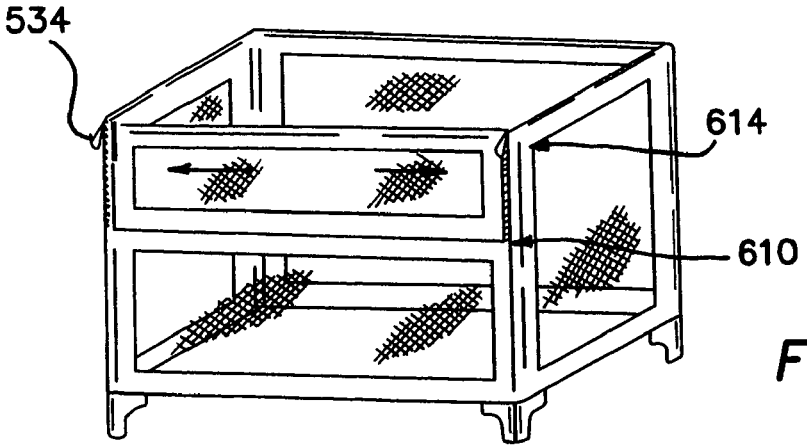
FIG. 17 is a perspective view similar to the FIG. 15, showing the ninth embodiment of the invention in an enclosed condition.
Figure 16:
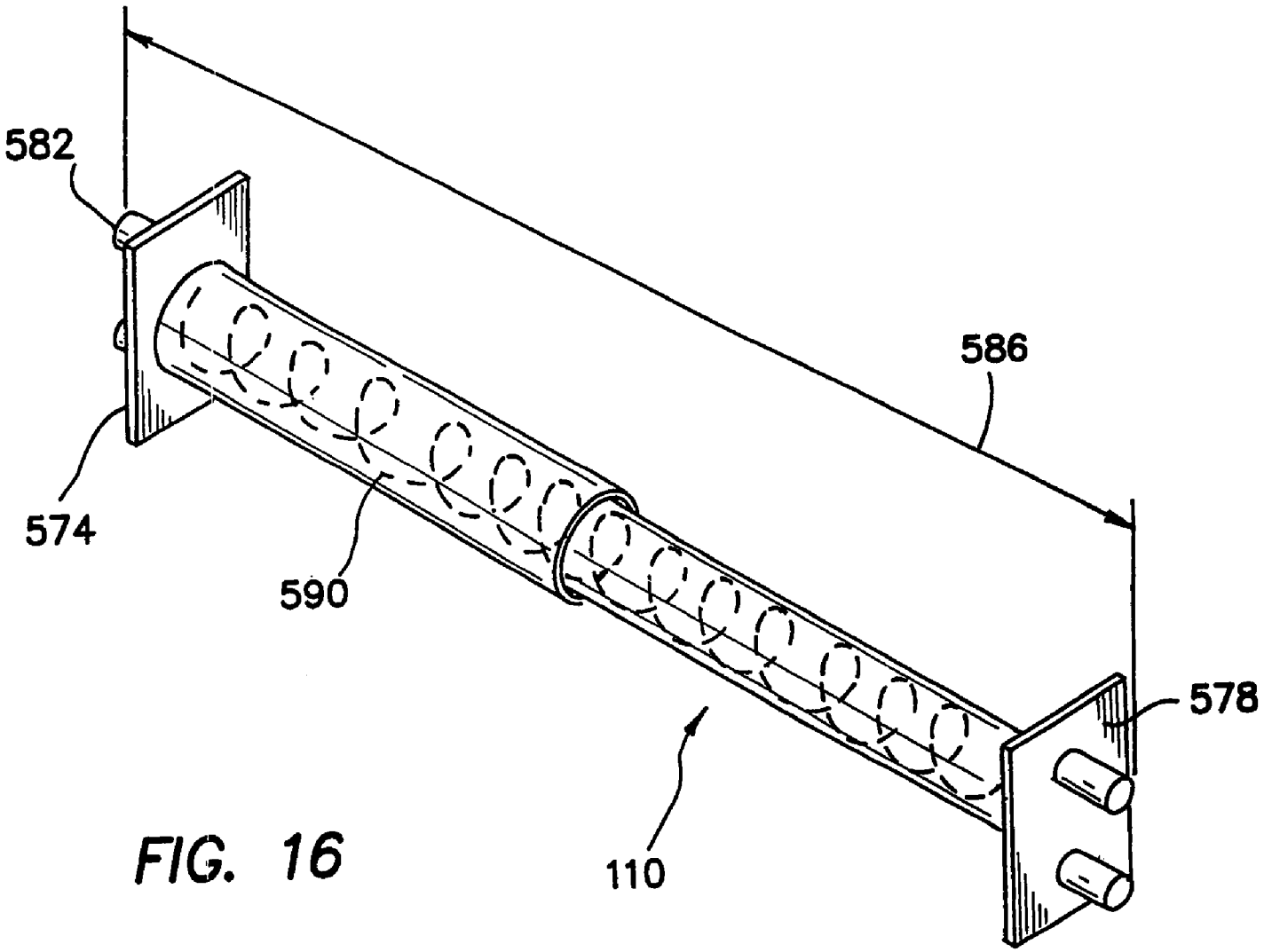
FIG. 16 is a detailed perspective view of the tubular member of the FIG. 15 in part.

In yet another variant, as shown in FIGS. 15, 16, and 17, the front upper horizontal rail 110 includes first 574 and second 578 tubular members. The tubular members 574, 578 are sealed at their outer ends 582, are sized and shaped to fit slidably within one another and having a combined length 586 greater than the front upper horizontal rail 110. A compression spring 590 is provided. The spring 590 is located within the tubular members 574, 578 and urges the outer ends 582 apart from one another. First 594 and second 598 upper sockets are provided. The upper sockets 594, 598 are located at the upper ends 158 of the front vertical rails 142, 146 and are sized and shaped to slidably receive the outer ends 582 of the first 574 and second 578 tubular members. First 602 and second 606 intermediate sockets are provided. The intermediate sockets 602, 606 are located at the intermediate points 610 of the front vertical rails 142, 146 and are sized and shaped to slidably receive the outer ends 582 of the first 574 and second 578 tubular members.

When the first 574 and second 578 tubular members are urged toward one another, compressing the spring 590, the outer ends 582 of the members 574, 578 will be withdrawn from the upper 594, 598 or intermediate 602, 606 sockets and the front upper horizontal rail 110 will be movable to a raised 614 or a lowered 618 position. When the first 574 and second 578 tubular members are released, the spring 590 will seat the outer ends 582 of the members 574, 578 in the upper 594, 598 or intermediate 602, 606 sockets, thereby adjusting a height of the front wall 26 of the play yard 10.

In a further variant of the invention, as shown in FIG. 15, the means 570 for reversibly attaching the first 558 and second 562 side edges of the flexible panel 546 to the first 34 and second 38 side walls is selected from the group comprising hooking and looping means (not shown), zippers 534 and snaps (not shown).

Figure 18:
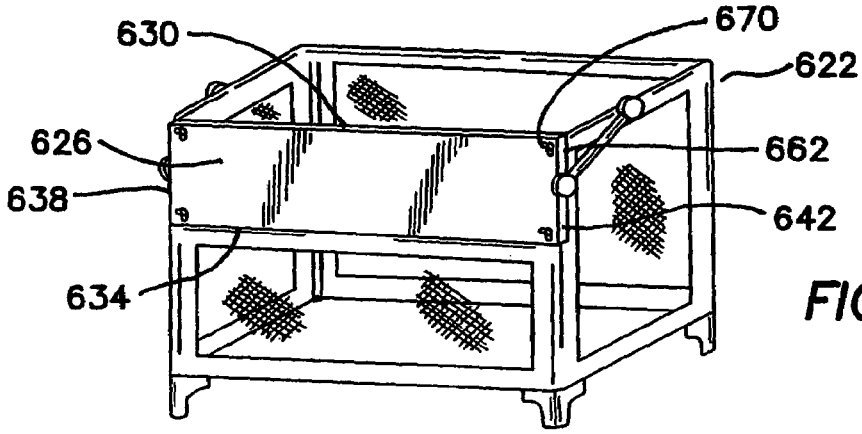
FIG. 18 is a perspective view of a tenth embodiment of the invention, having a pair of positioning arms pivotally mounted at a front panel and two upper horizontal rails.
Figure 19:
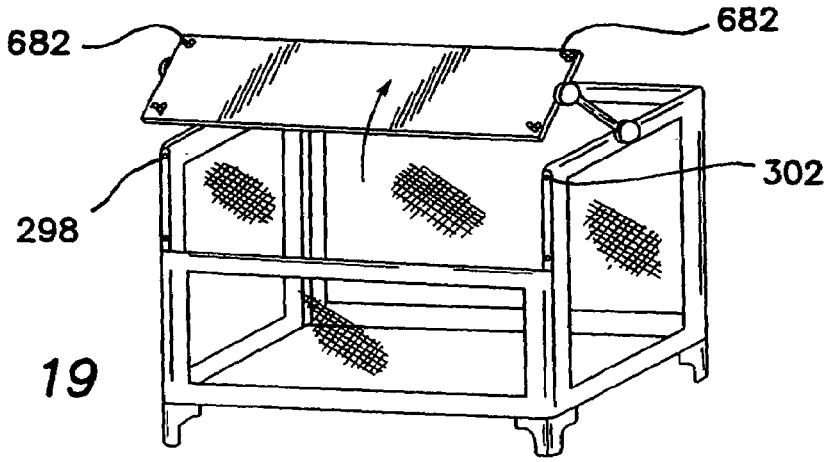
FIG. 19 is another perspective view of the FIG. 18 embodiment, illustrating the operation of the front panel and the positioning arms.

In yet a further variant, as shown in FIGS. 18 and 19, a rigid frame 622 is provided. The rigid frame 622 supports the floor 22, the front wall 26, the back wall 30, the first side wall 34 and the second side wall 38 of the first enclosure 14. The frame 622 is formed adjacent the top 18 by a rear upper horizontal rail 114 orthogonally connected to first 118 and second 122 upper side horizontal rails. The frame 622 is formed adjacent the floor 22 by front 126 and rear 130 lower parallel horizontal rails orthogonally connected to first side 134 and second side 138 lower parallel horizontal rails. The upper 114, 118, 122 and lower 126, 130, 134, 138 horizontal rails are orthogonally connected by first 142 and second 146 front vertical rails and a pair of rear vertical rails 150, 154 located at ends of the horizontal rails 114, 118, 122, 126, 130, 134, 138. The front vertical rails 142, 146 have an upper end 158 and a lower end 162.

An intermediate front horizontal rail 322 is provided. The intermediate rail 322 is orthogonally connected to the front vertical rails 142, 146 and is spaced downwardly from the upper ends 158 of the front vertical rails 142, 146 by a third predetermined distance 422. A rigid panel 626 is provided. The rigid panel 626 has upper 630 and lower 634 edges, first 638 and second 642 side edges and extends from the first front vertical rail 142 to the second front vertical rail 146 and the rigid panel 626 extends downwardly from the upper ends 158 of the front vertical rails 142, 146 for a second predetermined distance 286. First 646 and second 650 positioning arms are provided. The positioning arms 646, 650 have first 654 and second 658 ends, are pivotally mounted at their first ends 654 to the first 118 and second 122 upper side horizontal rails and are pivotally mounted at their second ends 658 to the first 638 and second 642 side edges of the rigid panel 626.

The rigid panel 626 is movable from a first, lowered position 662 where the upper edge 630 of the rigid panel 626 is located adjacent the upper ends 158 of the front vertical rails 142, 146, to a second, raised position 666 wherein the upper edge 630 of the rigid panel 626 is located adjacent the rear upper horizontal rail 114. Means 670 are provided for securing the rigid panel 626 in either of the first 662 and second 666 positions. When the rigid panel 626 is secured in the first, lowered position 662, all of the walls 26, 30, 34, 38 of the play yard 10 will be of similar height and suitable for use as a play yard 10 or bassinet and when the rigid panel 626 is secured in the second, raised position 666, the play yard 10 will have a lowered front wall 26 and be suitable for use as either of a changing table and a co-sleeper.

In still a further variant, as shown in FIG. 20, the means 670 for securing the rigid panel 626 in either of the first 662 and second 666 positions includes first 298 and second 302 threaded orifices. The first 298 and second 302 threaded orifices are located upon the first 142 and second 146 front vertical rails and face toward the rigid panel 626 when the rigid panel 626 is located in the first, lowered position 662. Third 674 and fourth 678 threaded orifices are provided. The third 674 and fourth 678 threaded orifices are located upon the first 150 and second 154 rear vertical rails and face toward the rigid panel 626 when the rigid panel 626 is located in the second, raised position 666. At least two threaded fasteners 306, 310 are provided. The threaded fasteners 306, 310 are sized and shaped to threadedly engage the threaded orifices 298, 302, 674, 678 and are rotatably mounted to holes 682 adjacent the first 638 and second 642 side edges of the rigid panel 626, the holes 682 are located to allow the threaded fasteners 306, 310 to removably engage the threaded orifices 298, 302, 674, 678.

When the threaded fasteners 306, 310 are rotated to engage the first 298 and second 302 threaded orifices, the rigid panel 626 will be secured to the front vertical rails 142, 146 thereby forming a rigid first enclosure 14 with walls 26, 30, 34, 38 of equal height and when the threaded fasteners 306, 310 are rotated to engage the third 674 and fourth 678 threaded orifices, the rigid panel 626 will be secured to the rear vertical rails 150, 154 thereby forming a rigid first enclosure 14 having one lowered wall 26.

Figure 21:
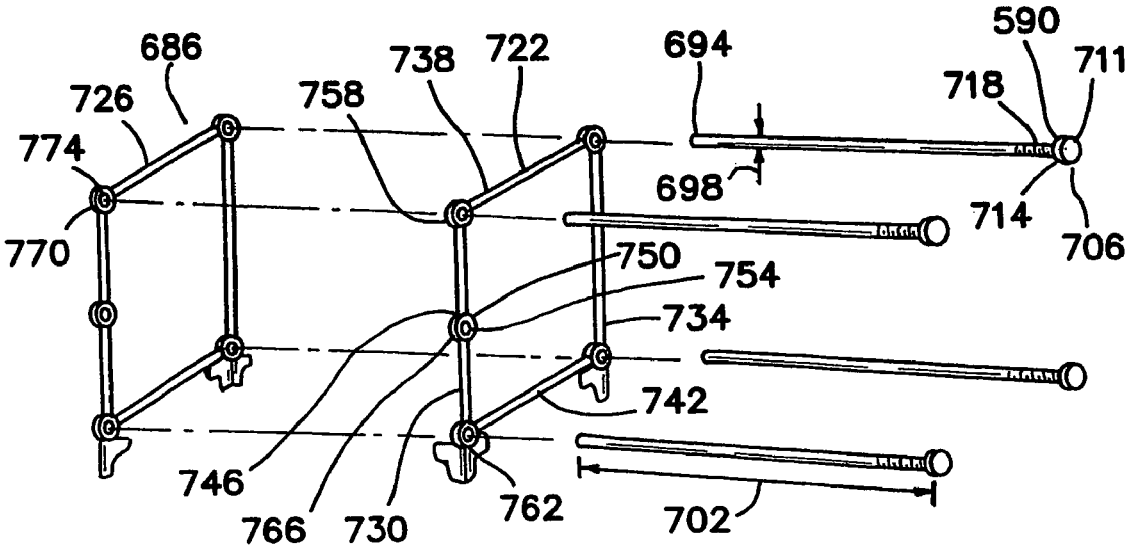
FIG. 21 is a perspective view of an eleventh embodiment of the invention, having at least four tensioning bars, attachment portions, and two side frames.
Figure 22:
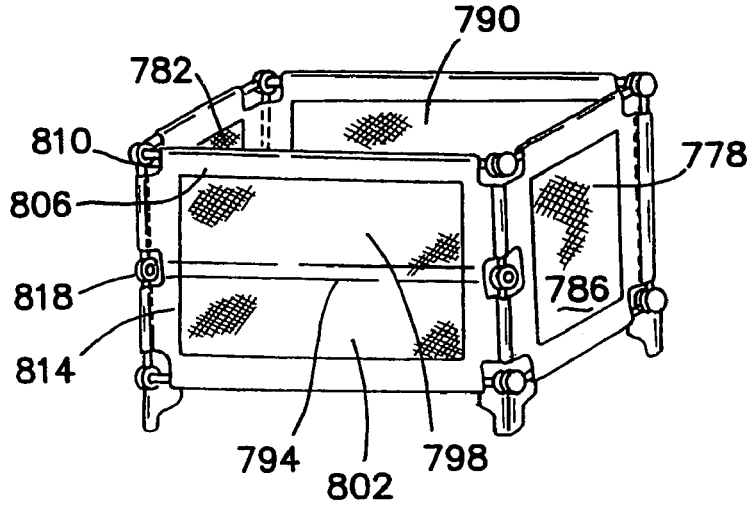
FIG. 22 is another perspective view of the FIG. 21 embodiment, illustrating the invention in an enclosed condition.
Figure 24:
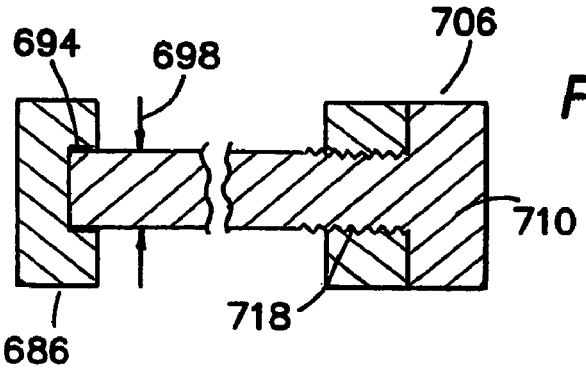
FIG. 24 is a detailed cross-sectional view of the attachment portion of the FIGS. 21, 22, and 23 embodiment in part.

In another variant, as shown in FIGS. 21, 22, and 24, at least four tensioning bars 686 are provided. Each of the tensioning bars 686 has first 690 and second 694 ends, a first predetermined diameter 698, a first predetermined length 702, and a rotating means 706 attached to the first end 690. The rotating means 706 has a handle 710 and an attachment portion 714. The attachment portion 714 has an external thread 718 located between the handle 710 and the tensioning bar 686. First 722 and second 726 side frames are provided. Each of the first 722 and second 726 side frames have parallel front 730 and rear 734 vertical rails, the vertical rails 730, 734 are orthogonally connected to upper 738 and lower 742 horizontal rails.

The first side frame 722 has at least five internally threaded fixtures 746, each of the internally threaded fixtures 746 includes an orifice 750 collinear with the internal threading 754. The orifice 750 is sized to permit passage of the first predetermined diameter 698 of the tensioning bar 686. The internal threading 754 is sized and shaped to engage the external thread 718 of the attachment portion 714. The internally threaded fixtures 746 are located upon the front 730 and rear 734 vertical rails of the first side frame 722, at upper 758 and lower 762 ends of the vertical rails 730, 734 and at a first point 766 between the upper 758 and lower 762 ends of the front vertical rail 730, 734. The orifices 750 of the internally threaded fixtures 746 are located orthogonally to the vertical rails 730, 734 and the horizontal rails 738, 742.

The second side frame 726 has at least five receiving sockets 770. Each of the receiving sockets 770 has a closed end 774 and is sized, shaped and located to slidably accept the second end 694 of the tensioning bar 686. The receiving sockets 770 are located upon the front 730 and rear 734 vertical rails of the second side frame 726, at upper 758 and lower 762 ends of the vertical rails 730, 734 and at a first point 766 between the upper 758 and lower 762 ends of the front vertical rail 730, 734. The orifices 750 of the internally threaded fixtures 746 are located orthogonally to the vertical rails 730, 734 and the horizontal rails 738, 742.

First 778 and second 782 side walls are provided. Each of the first 778 and second 782 side walls is formed of flexible material 786 and extends from the front vertical rails 730 to the rear vertical rails 734 and from the upper horizontal rails 738 to the lower horizontal rails 742. A rear wall 790 is provided. The rear wall 790 is formed of flexible material 786 and extends from the upper ends 758 to the lower ends 762 of the rear vertical rails 734. The rear wall 790 has a length equal to the first predetermined length 702. A front wall 794 is provided. The front wall 794 is formed of flexible material 786 and extends from the upper ends 758 to the lower ends 762 of the front vertical rails 730, the front wall 794 having a length equal to the first predetermined length 702.

The front wall 794 has an upper section 798 and a lower section 802. The upper section 798 extends from the upper ends 758 of the front vertical rails 730 to the first point 766 on the front vertical rails 730. The lower section 802 extends from the first point 766 to lower ends 762 of the front vertical rails 730. The upper section 798 has an upper edge 806, the upper edge 806 comprising a first passageway 810, the first passageway 810 is sized and shaped to fit slidably over one of the tensioning bars 686. The lower section 802 has an upper edge 814, the upper edge 814 comprising a second passageway 818. The second passageway is sized and shaped to fit slidably over one of the tensioning bars 686. The tensioning bars 686 serve to stretch the front 794 and rear 790 walls between the first 722 and second 726 side frames when the second ends 694 are located in the receiving sockets 770 and the external thread 718 of the rotating means 706 engages the internal threading 754of the internally threaded fixtures 746 and the handles 710 of the attachment portions 714are turned to urge the first side frame 722 away from the second side frame 726.

When one of the tensioning bars 686 is inserted into an internally threaded fixture 746 at the upper end 758 of the front vertical rail 730 of the first side frame 722, through the first passageway 810 and into a receiving socket 770 at the upper end 758 of the front vertical rail 730 of the second side frame 726, the front wall 794 will have a first height 822 equal to the side 778, 782 and back 790 walls, suitable for use as a play yard or bassinet. When one of the tensioning bars 686 is inserted into an internally threaded fixture 746 at the first point 766 on the front vertical rail 730 of the first side frame 722, through the second passageway 818 and into a receiving socket 770 at the first point 766 on the front vertical rail 730 of the second side frame 726 the front wall 794 will have a second, lowered height 826, suitable for use as a changing table or co-sleeper.

Figure 23:
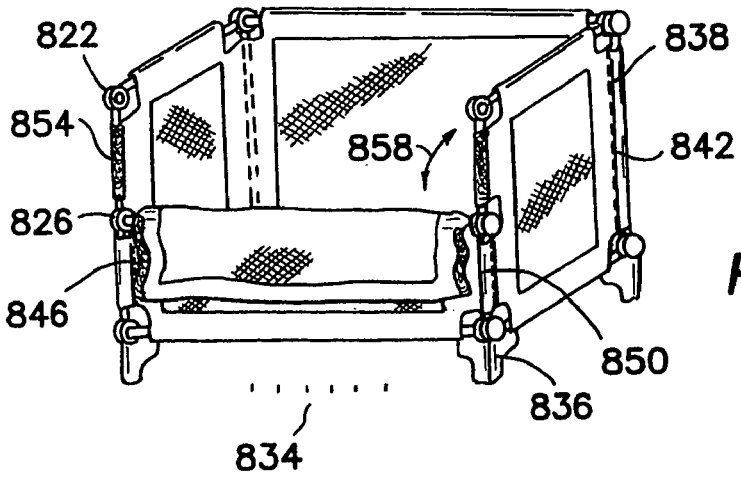
FIG. 23 is a still another perspective view of the FIG. 21 embodiment, illustrating the lowering means of the front panel of the invention.

In still another variant, as shown in FIGS. 22 and 23, foot extension members 830 are provided. The foot extension members 830 are attached to the lower ends 762 of the front 730 and rear 734 vertical rails. The foot extension members 830 serve to elevate the play yard 10 above a ground surface 834.

In yet another variant, as shown in FIG. 23, means 838 are provided for attaching the back wall 790 to the first 778 and second 782 side walls at rear edges 842 thereof.

In a further variant, as shown in FIG. 23, means 846 are provided for attaching the lower section 802 of the front wall 794 to the first 778 and second 782 side walls at front edges 850 thereof. Means 854 are provided for removably attaching the upper section 798 of the front wall 794 to the first 778 and second 782 side walls at front edges 854 thereof.

When one of the tensioning bars 686 is inserted into an internally threaded fixture 746 at the upper end 758 of the front vertical rail 730 of the first side frame 722, through the first passageway 810 and into a receiving socket 770 at the upper end 758 of the front vertical rail 730 of the second side frame 726 and the removable attachment means 854 is attached, the play yard 10 will have the first height 822 equal to the side 778, 782 and back 790 walls, suitable for use as a play yard 10 or bassinet and no side openings 858 will be available adjacent the upper section 798 of the front wall 794, and when one of the tensioning bars 686 is inserted into an internally threaded fixture 746 at the first point 766 on the front vertical rail 730 of the first side frame 722, through the second passageway 818 and into a receiving socket 770 at the first point 766 on the front vertical rail 730 of the second side frame 726 and the removable attachment means 854 is detached, the front wall 794 will have a second, lowered height 826, suitable for use as a changing table or co-sleeper.

Figure 28:
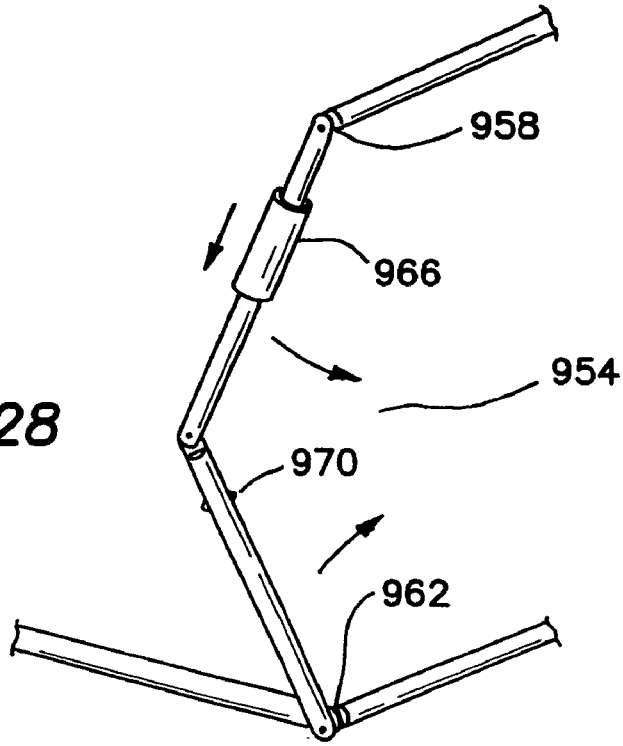
FIG. 28 is a detailed perspective view of the tensioning bars pivotally mounted at the horizontal rails of the FIG. 25 embodiment in part
Figure 31:
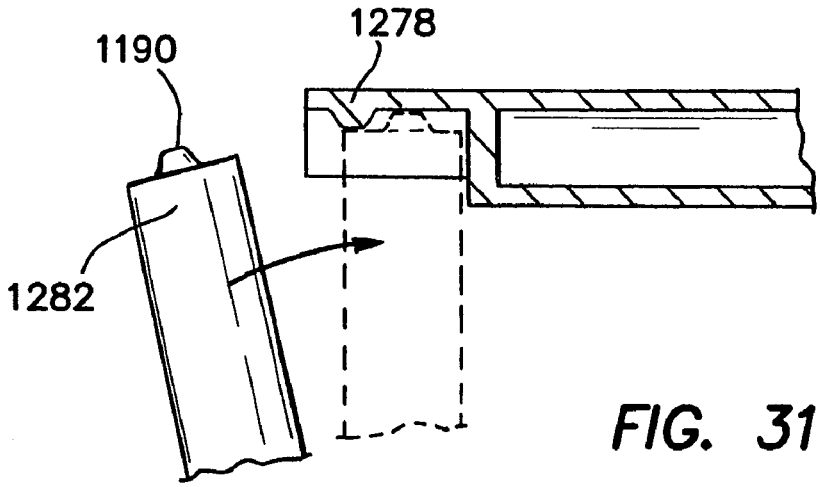
FIG. 31 is a cross sectional view of the FIG. 29 embodiment in part, illustrating the positioning means of the bottom frame at the top frame.
Figure 25:
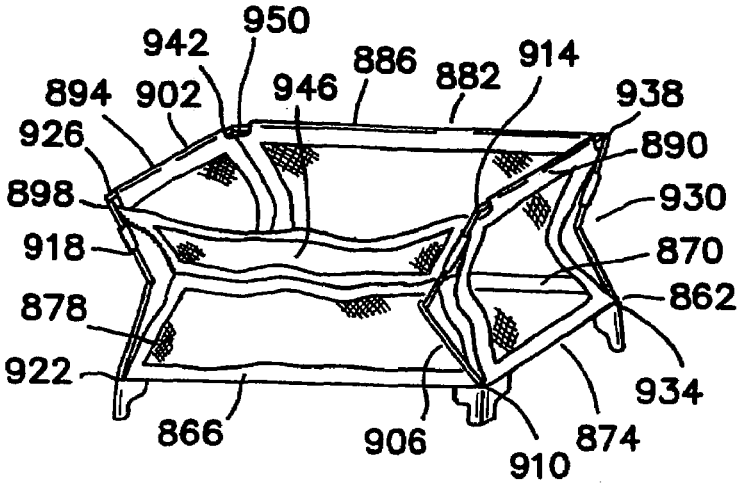
FIG. 25 is a perspective view of a twelfth embodiment of the invention, having tensioning members pivotally mounted at horizontal rails.

In yet a further variant of the invention, as shown in FIGS. 25 and 28, a bottom frame 862 is provided. The bottom frame 862 comprises front 866 and rear 870 lower horizontal rails orthogonally connected to first 874 and second 878 side lower horizontal rails. A top frame 882 is provided. The top frame 882 comprising a rear upper horizontal rail 886 orthogonally connected to first 890 and second 894 side upper horizontal rails. Each of the upper horizontal rails 886, 890, 894 has at least one securing protrusion 898 on a downward facing surface 902 of the rail 886, 890, 894.

A first tensioning member 906 is provided. The first tensioning member 906 has a first end 910 and a second end 914 and is pivotally mounted at the first end 910 to the first side lower horizontal rail 874. A second tensioning member 918 is provided. The second tensioning member 918 has a first end 922 and a second end 926 and is pivotally mounted at the first end 922 to the second side lower horizontal rail 878. A third tensioning member 930 is provided. The third tensioning member 930 has a first end 934 and a second end 938 and is pivotally mounted at the first end 934 to the rear lower horizontal rail 870. A fourth tensioning member 942 is provided. The fourth tensioning member 942 has a first end 946 and a second end 950 and is pivotally mounted at the first end 946 to the rear lower horizontal rail 870.

A position retaining device 954 is provided. The position retaining device 954 (is formed of resilient material and) has a first end 958, a second end 962 and a concave upper surface 966, the upper surface 966 has a ridge 970. The position retaining device 954 is attached at its first end 958 to each of the second ends 914, 926, 938, 950 of the tensioning members 906, 918, 930, 942. A first side wall 974 is provided. The first side wall 974 is formed of flexible material 978, has front 982 and rear 986 edges and extends from the first side lower horizontal rail 874 to the first side upper horizontal rail 890 for a first predetermined height 990. A second side wall 994 is provided. The second side wall 994 is formed of flexible material 978, has front 998 and rear 1002 edges and extends from the second side lower horizontal rail 878 to the second side upper horizontal rail 894 for the first predetermined height 990.

A back wall 1006 is provided. The back wall 1006 is formed of flexible material 978, has first 1010 and second 1014 side edges and extends from the rear lower horizontal rail 870 to the rear upper horizontal rail 886 for the first predetermined height 990. A front wall 1018 is provided. The front wall 1018 is formed of flexible material 978, has a top edge 1022, first 1026 and second 1030 side edges and extends from the front lower horizontal rail 866 upwardly to a level of the first 890 and second 894 side upper horizontal rails for the first predetermined height 990. The front wall 1018 is attached at its first edge 1026 to the front edge 982 of the first side wall 974 and attached at its second edge 1030 to the front edge 998 of the second side wall 994.

The front wall 1018 includes first 1034 and second 1038 lowering means. The lowering means 1034, 1038 are spaced inwardly from the first 1026 and second 1030 side edges and extend downwardly from the top edge 1022 for a first predetermined distance 1042. The lowering means 1034, 1038 comprise a reclosable linear opening 1046 and permit the front wall 1018 to have the first predetermined height 990 when closed and a second, lower predetermined height 1050 when opened. The first 906, second 918, third 930 and fourth 942 tensioning members have a first predetermined length 1054. The first predetermined length 1054 is sufficient to stretch the first 974 and second 994 side walls, and back 1006 and front 1018 walls to the first predetermined height 990 when the tensioning members 906, 918, 930, 942 are pivoted upwardly from the rear lower horizontal rail 870 and first 874 and second 878 side lower horizontal rails such that the ridge 970 on the concave upper surface 966 of the position retaining device 954 at the second end 914, 926, 938, 950 of each tensioning member 906, 918, 930, 942 is forced past the securing protrusion 898 on the downward facing surface 902 of the each of the upper horizontal rails 886, 890, 894.

Figure 26:
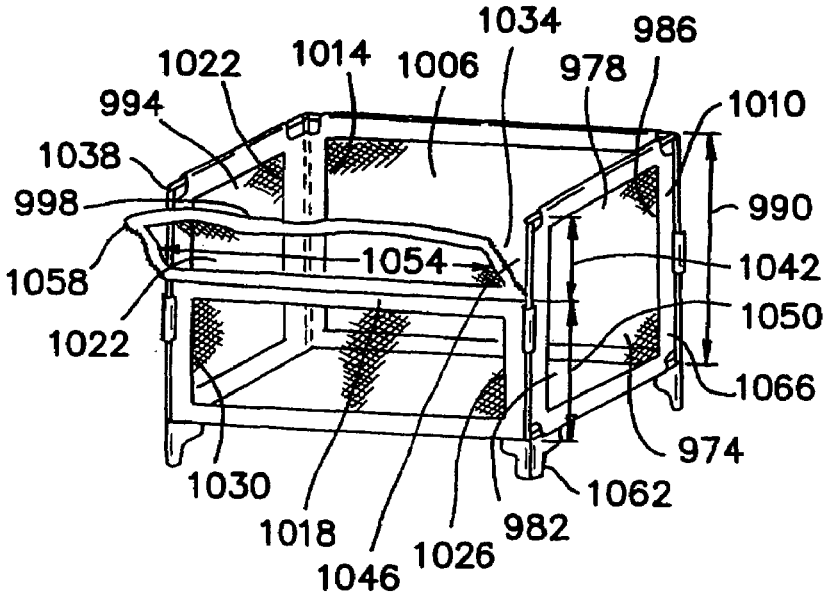
FIG. 26 is another perspective view of the FIG. 25 embodiment, illustrating a lowering and securing means of the front panel.

In another variant, as shown in FIG. 26, the reclosable linear opening 1046 of the lowering means 1034, 1038 is closed by means selected from the group comprising zippers (not shown), snaps (not shown), hooks (not shown), buttons (not shown) and hooking and looping means 1058.

In still another variant of the invention, as shown in FIG. 26, foot extension members 1062 are provided. The foot extension members 1062 are attached to undersides of either of the front 886 and rear 870 lower horizontal rails and the first 874 and second 878 side lower horizontal rails. The foot extension members 1062 serve to elevate the play yard 10 above a ground surface 834.

In a further variant, as shown in FIG. 26, means 1066 are provided for attaching the back wall 1006 to the first 974 and second 994 side walls at rear edges 986, 1002 of the side walls 974, 994.

Figure 27:
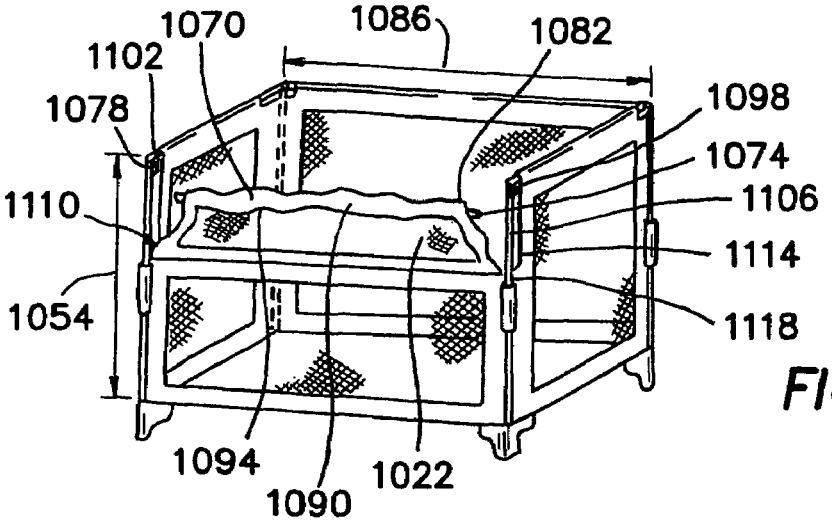
FIG. 27 is a still another perspective view of the FIG. 25 embodiment, further illustrating a different lowering and securing means of the front panel.

In still a further variant, as shown in FIG. 27, a front upper horizontal rail 1070 is provided. The front upper horizontal rail 1070 includes first 1074 and second 1078 tubular members. The tubular members 1074, 1078 are sealed at their outer ends 1082, are sized and shaped to fit slidably within one another and having a combined length greater 1086 than the front upper horizontal rail 1070. A compression spring 1090 is provided. The spring 1090 is located within the tubular members 1074, 1078 and urges the outer ends 1082 apart from one another. A passageway 1094 is provided. The passageway 1094 is located at the top edge 1022 of the front wall 1018 and is sized and shaped to fit slidably over the front upper horizontal rail 1070. The front upper horizontal rail 1070 is located within the passageway 1094. First 1098 and second 1102 upper sockets are provided. The upper sockets 1098, 1102 are located at outer ends 1016 of the first 890 and second 894 side upper horizontal rails and are sized and shaped to slidably receive the outer ends 1082 of the first 1074 and second 1078 tubular members.

First 1106 and second 1110 intermediate sockets are provided. The intermediate 1106, 1110 sockets are located at intermediate points 1114 of the first 906 and second 918 tensioning members and are sized and shaped to slidably receive the outer ends 1082 of the first 1074 and second 1078 tubular members. When the lowering means 1034, 1038 are opened and the first 1074 and second 1078 tubular members are urged toward one another, compressing the spring 1090 the outer ends 1082 of the members 1074, 1078 will be withdrawn from either of the upper 1098, 1102 and intermediate 1106, 1110 sockets and the front upper horizontal rail 1070 will be movable to either of a raised 1114 and a lowered 1118 position. When the first 1074 and second 1078 tubular members are released, the spring 1090 will seat the outer ends 1082 of the members 1074, 1078 in either of the upper 1098, 1102 and intermediate 1106, 1110 sockets, the lowering means 1034, 1038 is closed for the raised position 1114, thereby adjusting a height 990, 1050 of the front wall 1018 of the play yard 10.

Figure 29:
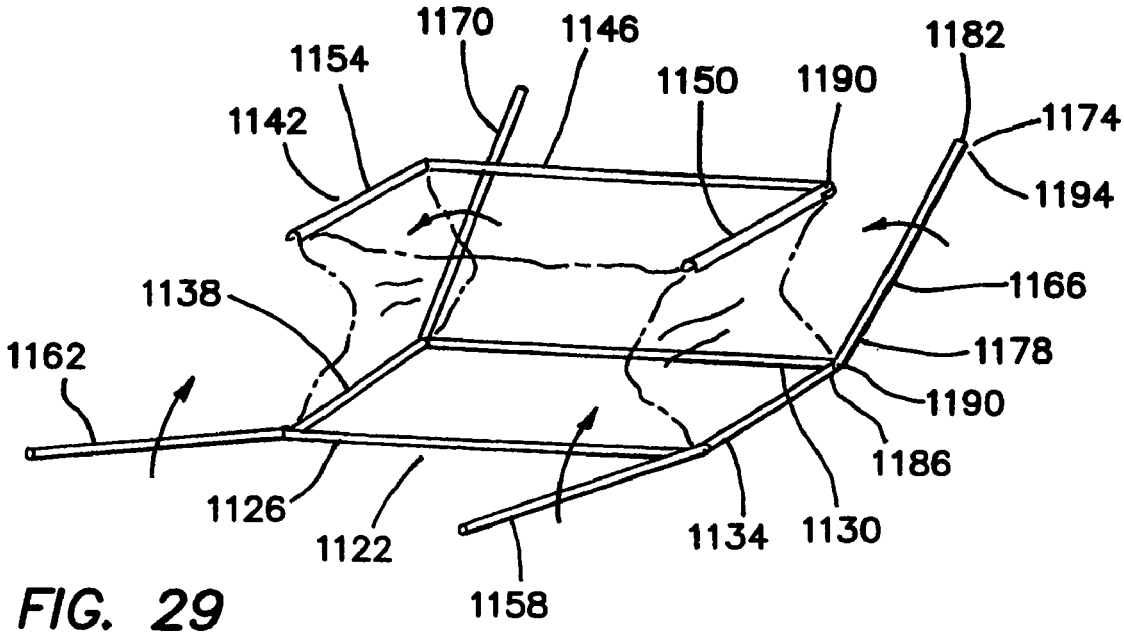
FIG. 29 is a perspective view of a thirteenth embodiment of the invention, having a bottom and top frames.

In yet a further variant of the invention, as shown in FIG. 29, a bottom frame 1122 is provided. The bottom frame 1122 comprises front 1126 and rear 1130 lower horizontal rails orthogonally connected to first 1134 and second 1138 side lower horizontal rails. A top frame 1142 is provided. The top frame 1142 comprises a rear upper horizontal rail 1146 orthogonally connected to first 1150 and second 1154 side upper horizontal rails. First 1158, second 1162, third 1166 and fourth 1170 support members are provided. Each of the support members 1158, 1162, 1166, 1170 has an upper portion 1174 and an equal length lower portion 1178. Each of the upper 1174 and lower 1178 portions has a first end 1182 and a second end 1186. The upper 1174 and lower 1178 portions are joined at their second ends 1186 at a hinge 1190. The hinge 1190 permits the upper 1174 and lower 1178 portions to rotate between zero and slightly more that 180 degrees with respect to each other.

Means 1194 are provided for controlling the rotation of the upper 1174 and lower 1178 portions about the hinge 1190. The upper 1174 and lower 1178 portions of the first support member 1158 are pivotally mounted at their first ends 1182 to the first side upper 1150 and lower 1134 horizontal rails. The upper 1174 and lower 1178 portions of the second support member 1162 are pivotally mounted at their first ends 1182 to the second side upper 1154 and lower 1138 horizontal rails. The upper 1174 and lower 1178 portions of the third support member 1166 are pivotally mounted at their first ends 1182 to the rear upper 1146 and lower 1130 horizontal rails. The upper 1174 and lower 1178 portions of the fourth support member 1170 are pivotally mounted at their first ends 1182 to the rear upper 1146 and lower 1130 horizontal rails.

A first side wall 1198 is provided. The first side wall 1198 is formed of flexible material 978, has front 1202 and rear 1206 side edges and extends from the first side lower horizontal rail 1134 to the first side upper horizontal rail 1150 for a first predetermined height 1210. A second side wall 1214 is provided. The second side wall 1214 is formed of flexible material 978, has front 1218 and rear 1222 side edges and extends from the second side lower horizontal rail 1138 to the second side upper horizontal rail 1154 for the first predetermined height 1210. A back wall 1226 is provided. The back wall 1226 is formed of flexible material 978, has first 1230 and second 1234 side edges and extends from the rear lower horizontal rail 1130 to the rear upper horizontal rail 1146 for the first predetermined height 1210. A front wall 1238 is provided. The front wall 1238 is formed of flexible material 978, has a top edge 1242, first 1246 and second 1250 side edges and extends from the front lower horizontal rail 1126 upwardly to a level of the first 1150 and second 1154 side upper horizontal rails for the first predetermined height 1210.

The front wall 1238 is attached at its first side edge 1246 to the front edge 1202 of the first side wall 1198 and attached at its second side edge 1250 to the front edge 1218 of the second side wall 1214. The front wall 1238 includes first 1254 and second 1258 lowering means. The lowering means 1254, 1258 are spaced inwardly from the first 1246 and second 1250 side edges and extend downwardly from the top edge 1242 for a first predetermined distance 1262. The lowering means 1254, 1258 comprise a reclosable linear opening 1266 and permit the front wall 1238 to have the first predetermined height 1210 when closed and a second, lower predetermined height 1270 when opened.

The first 1158, second 1162, third 1166 and fourth 1170 support members have a first predetermined length 1274, the first predetermined length 1274 is sufficient to stretch the first 1198 and second 1214 side walls and back 1226 and front 1238 walls to the first predetermined height 1210 when the upper 1174 and lower 1178 portions of the support members are rotated at least 180 degrees from each other.

In another variant, as shown in FIG. 29, the means 1194 for controlling the rotation of the upper 1174 and lower 1178 portions about the hinge 1190 further comprises a sleeve 1278. The sleeve 1278 is sized and shaped to fit slidably over the binge 1190. A ledge 1282 is provided. The ledge 1282 is attached to the lower portion 1178 of the support member 1158, 1162, 1166 1170 at a height sufficient to position the sleeve 1278 to enclose the hinge 1190. When the sleeve 1278 is positioned on the ledge 1282, the upper portion 1174 of the support member 1158, 1162, 1166 1170 cannot rotate with respect to the lower portion 1178 of the support member 1158, 1162, 1166 1170. When the sleeve 1278 is raised above the hinge 1190, the upper portion 1174 of the support member 1158, 1162, 1166 1170 can rotate with respect to the lower portion 1178 of the support member 1158, 1162, 1166 1170, permitting the play yard 10 to be collapsed for transport and storage.

Figure 30:
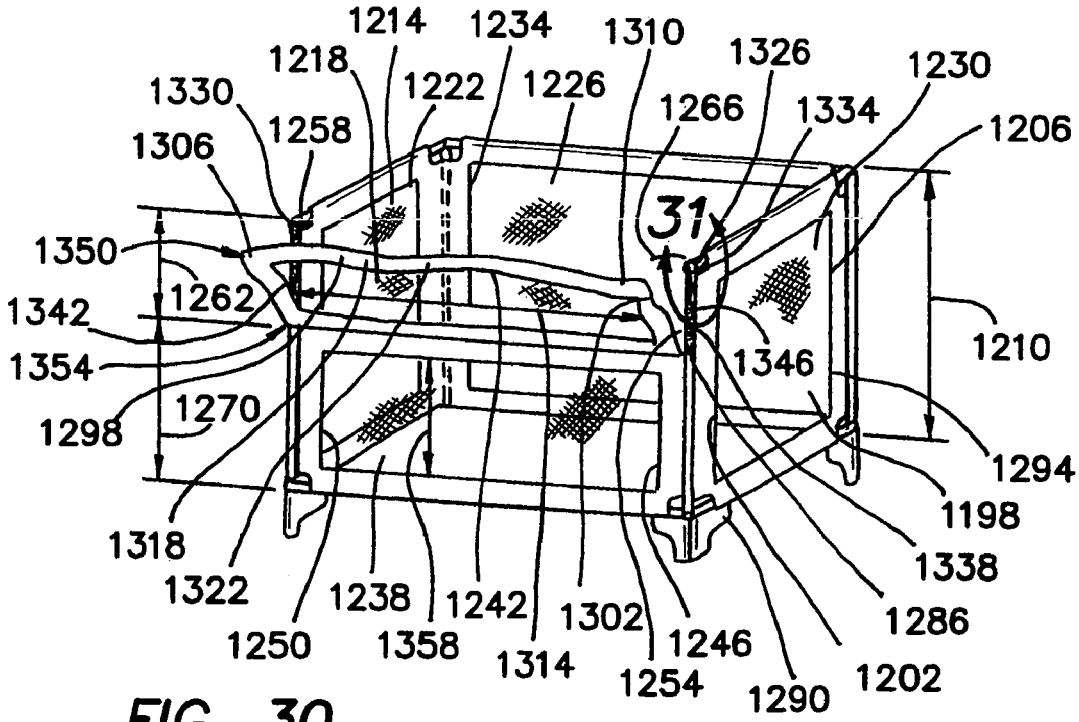
FIG. 30 is another perspective view of the FIG. 29 embodiment, illustrating the invention in an enclosed condition, and lowering and securing means of a front panel.

In yet another variant, as shown in FIG. 30, the reclosable linear opening 1266 of the lowering means 1254, 1258 is closed by means selected from the group comprising zippers 1286, snaps (not shown), hooks (not shown), buttons (not shown) and hooking and looping means (not shown).

In still another variant, as shown in FIG. 30, foot extension members 1290 are provided. The foot extension members 1290 are attached to undersides of either of the front 1126 and rear 1130 lower horizontal rails and the first 1134 and second 1138 side lower horizontal rails. The foot extension members 1290 serve to elevate the play yard 10 above a ground surface 834.

In yet another variant of the invention, as shown in FIG. 30, means 1294 are provided for attaching the back wall 1126 to the first 1198 and second 1214 side walls at rear edges 1206, 1222 of the side walls 1198, 1214.

In yet a further variant, as shown in FIG. 30, a front upper horizontal rail 1298 is provided. The front upper horizontal rail 1298 comprises first 1302 and second 1306 tubular members. The tubular members 1302, 1306 are sealed at their outer ends 1310, are sized and shaped to fit slidably within one another and have a combined length 1314 greater than the front upper horizontal rail 1298. A compression spring 1318 is provided. The spring 1318 is located within the tubular members 1302, 1306 and urges the outer ends 1310 apart from one another. A passageway 1322 is provided. The passageway 1322 is located at the top edge 1242 of the front wall 1238 and is sized and shaped to fit slidably over the front upper horizontal rail 1298. The front upper horizontal rail 1298 is located within the passageway 1322.

First 1326 and second 1330 upper sockets are provided. The upper sockets 1326, 1330 are located at outer ends 1334 of the first 1150 and second 1154 side upper horizontal rails and are sized and shaped to slidably receive the outer ends 1334 of the first 1302 and second 1306 tubular members. First 1338 and second 1342 intermediate sockets are provided. The intermediate sockets 1338, 1342 are located at intermediate points 1346 of the first 1158 and second 1162 support members and are sized and shaped to slidably receive the outer ends 1334 of the first 1302 and second 1306 tubular members.

When the lowering means 1254, 1258 are opened and the first 1302 and second 1306 tubular members are urged toward one another, compressing the spring 1318, the outer ends 1334 of the members 1302, 1306 will be withdrawn from either of the upper 1326, 1330 and intermediate 1338, 1342 sockets and the front upper horizontal rail 1298 will be movable to either of a raised 1350 and a lowered position 1354, and when the first 1302 and second 1306 tubular members are released, the spring 1318 will seat the outer ends 1334 of the members 1302, 1306 in either of the upper 1326, 1330 and intermediate 1338, 1342 sockets, the lowering means 1254, 1258 are closed for the raised position 1350, thereby adjusting a height 1358 of the front wall 1238 of the play yard 10.

The multi-purpose convertible play yard 10 convertibly adapted for use as a bassinet, changing table or bedside co-sleeper has been described with reference to particular embodiments. Other modifications and enhancements can be made without departing from the spirit and scope of the claims that follow.

What is claimed is:

1. A multi-purpose convertible play yard convertibly adapted for use as a bassinet, changing table or bedside co-sleeper comprising;

a rigid first enclosure having an open top, a floor, a front wall, a back wall, a first side wall and a second side wall, said first side wall having a top edge; said first enclosure having a first height, said first height established by the top edge of said first side wall; a second enclosure, said second enclosure being sized to fit substantially within the first enclosure and having an open top, a back wall, a front wall, first and second side walls and a bottom;

means for removably supporting said second enclosure within the first enclosure;

a rigid frame, said rigid frame supporting the floor, the front wall, the back wall, the first side wall and the second side wall of said first enclosure, said frame being formed adjacent the top by a rear upper horizontal rail orthogonally connected to first and second upper side horizontal rails, and being formed adjacent the floor by front and rear lower parallel horizontal rails orthogonally connected to first side and second side lower parallel horizontal rails, said upper and lower horizontal rails being orthogonally connected by first and second front vertical rails and a pair of rear vertical rails disposed at ends of said horizontal rails, said front vertical rails having an upper end and a lower end;

a rigid panel, said rigid panel having upper and lower edges, first and second side edges and extending from said first front vertical rail to said second front vertical rail and extending downwardly from the upper end of said front vertical rails for a second predetermined distance; said rigid panel being hingedly attached at its lower edge to said first and second front vertical rails;

means for removably securing the first and second side edges of said rigid panel in a closed position, wherein said closed position, said first and second side edges of said rigid panel substantially parallel to said first and second front vertical rails;

a securing strap assembly for securing the play yard to a parental bed;

wherein said front wall is formed of flexible material and extends from a point below the lower edge of said rigid panel to said front lower horizontal rail and from said first front vertical rail to said second front vertical rail;

whereby, when the rigid panel is in the closed position and the second enclosure is supported by the supporting means, the play yard is usable as a bassinet; and wherein, when the rigid panel is not in the closed position, the play yard is usable as a changing table;

further, when the securing strap assembly is properly positioned and the play yard is secured to the parental bed the play yard may serve as a co-sleeper; and an intermediate front horizontal rail, said intermediate rail being orthogonally connected to said front vertical rails and being spaced downwardly from the upper ends of said vertical rails;

wherein said rigid panel is hingedly attached at its lower edge to said intermediate front horizontal rail; means for removably securing the first and second side edges of said rigid panel adjacent the upper ends of said front vertical rails; and said first enclosure front wall being formed of flexible material and extending from a point below the lower edge of said rigid panel to said front lower horizontal rail and from said first front vertical rail to said second front vertical rail.

2. A multi-purpose convertible play yard convertibly adapted for use as a bassinet, changing table or bedside co-sleeper comprising;

a rigid first enclosure having an open top, a floor, a front wall, a back wall, a first side wall and a second side wall, said first side wall having a top edge; said first enclosure having a first height, said first height established by the top edge of said first side wall; a second enclosure, said second enclosure being sized to fit substantially within the first enclosure and having an open top, a back wall, a front wall, first and second side walls and a bottom;

means for removably supporting said second enclosure within the first enclosure;

rigid frame, said rigid frame supporting the floor, the front wall, the back wall, the first side wall and the second side wall of said first enclosure, said frame being formed adjacent the top by a rear upper horizontal rail orthogonally connected to first and second upper side horizontal rails, and being formed adjacent the floor by front and rear lower parallel horizontal rails orthogonally connected to first side and second side lower parallel horizontal rails, said upper and lower horizontal rails being orthogonally connected by first and second front vertical rails and a pair of rear vertical rails disposed at ends of said horizontal rails, said front vertical rails having an upper end and a lower end;

a rigid panel, said rigid panel having upper and lower edges, first and second side edges and extending from said first front vertical rail to said second front vertical rail and extending downwardly from the upper end of said front vertical rails for a second predetermined distance; said rigid panel being hingedly attached at its lower edge to said first and second front vertical rails;

means for removably securing the first and second side edges of said rigid panel in a closed position, wherein said closed position, said first and second side edges of said rigid panel substantially parallel to said first and second front vertical rails;

a securing strap assembly for securing the play yard to a parental bed;

wherein said front wall is formed of flexible material and extends from a point below the lower edge of said rigid panel to said front lower horizontal rail and from said first front vertical rail to said second front vertical rail;

whereby, when the rigid panel is in the closed position and the second enclosure is supported by the supporting means, the play yard is usable as a bassinet; and wherein, when the rigid panel is not in the closed position, the play yard is usable as a changing table; and further, when the securing strap assembly is properly positioned and the play yard is secured to the parental bed the play yard may serve as a co-sleeper; and an intermediate front horizontal rail, said intermediate rail being orthogonally connected to said front vertical rails and being spaced downwardly from the upper ends of said vertical rails; third and fourth receiving tracks, said receiving tracks being disposed upon said first and second front vertical rails and facing inwardly toward each other; said receiving tracks extending downwardly from the upper ends of said front vertical rails; wherein said rigid panel is sized and shaped to fit slidably and removably between said third and fourth receiving tracks; and whereby, when said rigid panel is removed from said third and fourth receiving tracks, the play yard will have a lowered front wall and be suitable for use as either of a changing table and a co-sleeper and when said rigid panel is installed between said tracks, all of the walls of the first enclosure will be of similar height and be suitable for use as a play yard or bassinet if the second enclosure is removed.

3. A multi-purpose convertible play yard convertibly adapted for use as a bassinet, changing table or bedside co-sleeper comprising;

a rigid first enclosure having an open top, a floor, a front wall, a back wall, a first side wall and a second side wall, said first side wall having a top edge; said first enclosure having a first height, said first height established by the top edge of said first side wall; a second enclosure, said second enclosure being sized to fit substantially within the first enclosure and having an open top, a back wall, a front wall, first and second side walls and a bottom;

means for removably supporting said second enclosure within the first enclosure;

a rigid frame, said rigid frame supporting the floor, the front wall, the back wall, the first side wall and the second side wall of said first enclosure, said frame being formed adjacent the top by a rear upper horizontal rail orthogonally connected to first and second upper side horizontal rails, and being formed adjacent the floor by front and rear lower parallel horizontal rails orthogonally connected to first side and second side lower parallel horizontal rails, said upper and lower horizontal rails being orthogonally connected by first and second front vertical rails and a pair of rear vertical rails disposed at ends of said horizontal rails, said front vertical rails having an upper end and a lower end;

a rigid panel, said rigid panel having upper and lower edges, first and second side edges and extending from said first front vertical rail to said second front vertical rail and extending downwardly from the upper end of said front vertical rails for a second predetermined distance; said rigid panel being hingedly attached at its lower edge to said first and second front vertical rails;

means for removably securing the first and second side edges of said rigid panel in a closed position, wherein said closed position, said first and second side edges of said rigid panel substantially parallel to said first and second front vertical rails; and a securing strap assembly for securing the play yard to a parental bed;

at least one pair of tubular receivers, said receivers being affixed to said front wall; and first and second securing rods, said securing rods extending downwardly from the lower edge of said rigid panel and being sized, shaped and disposed to fit slidably within said receivers such that the upper edge of the rigid panel will be positioned at the upper end of said front vertical rails when the securing rods are positioned within said receivers;

wherein said front wall is formed of flexible material and extends from a point below the lower edge of said rigid panel to said front lower horizontal rail and from said first front vertical rail to said second front vertical rail;

whereby, when the rigid panel is in the closed position and the second enclosure is supported by the supporting means, the play yard is usable as a bassinet; and wherein, when the rigid panel is not in the closed position, the play yard is usable as a changing table; and further, when the securing strap assembly is properly positioned and the play yard is secured to the parental bed the play yard may serve as a co-sleeper;

whereby, when said securing rods are removed from said receivers, the play yard will have a lowered front wall and be suitable for use as either of a changing table and a co-sleeper and when said securing rods are installed in said receivers securing said rigid panel in place, all of the walls of the first enclosure will be of similar height and be suitable for use as a play yard or bassinet if the second enclosure is removed.

4. A multi-purpose convertible play yard convertibly adapted for use as a bassinet, changing table or bedside co-sleeper comprising;

a first enclosure having an open top, a floor, a front wall, and a first side wall and a second side wall, said first side wall and said second side wall each having a front edge and a top edge, said front edge connecting said first side wall and said second side wall to said front a rigid frame, said rigid frame supporting the first enclosure and having a lower front rail, a first vertical rail and a second vertical rail, said first and second vertical rails each having an upper end and a lower end, said first vertical rail being positioned adjacent said front edge of said first side wall and said second vertical rail being positioned adjacent to said front edges of said second side wall, a rigid panel, said rigid panel said rigid panel being selectively positionable between said first and said second vertical rails to form a closed position, said rigid panel having an upper and a lower edge and first and second side edges, said rigid panel extending from said first front vertical rail to said second front vertical rail and extending downwardly from the upper ends of said front vertical rails for a first distance when in said closed position;

rigid panel retainers for selectively securing said rigid panel to said frame in said closed position;

a second enclosure, said second enclosure being sized to fit substantially within the first enclosure and having an open top and a bottom;

an inner support, said inner support supporting the bottom of the second enclosure at a height above the height of the floor of the first enclosure; and a securing strap assembly for securing the play yard to a parental bed; and an intermediate rail connected between said first and said second vertical rails at positions a spaced downwardly along said rails from the upper ends of said vertical rails;

wherein said front wall extends upward from said front lower rail to at least a point adjacent the lower edge of said rigid panel when said rigid panel is in said closed position, and further extending from said first front vertical rail to said second front vertical rail;

whereby, when the second enclosure is supported by the inner support and the rigid panel is in a closed position and the second enclosure is supported by the inner support, the play yard is usable as a bassinet;

wherein, when the rigid panel is moved from the closed position, the play yard is usable as a changing table;

further, when the securing strap assembly is properly positioned and the play yard is secured to the parental bed the play yard may serve as a co-sleeper;

and wherein said rigid panel is hingedly attached to said intermediate front rail, said hinged attachment allowing said rigid panel to rotate about an axis parallel and adjacent to said intermediate front rail; and wherein said rigid panel attachments selectively secure said first and second side edges of said rigid panel adjacent the first and second vertical rails to retain said rigid panel in said closed position.

5. A multi-purpose convertible play yard adapted for use as a bassinet, changing table or bedside co-sleeper as described in claim 4, wherein the rigid panel retainers securing the rigid panel to the front vertical rails comprises;

at least two threaded orifices, said threaded orifices being disposed upon the first and second front rails and facing toward said rigid panel;

at least two threaded fasteners, said threaded fasteners being sized and shaped to threadedly engage said threaded orifices and being rotatably mounted to holes adjacent the first and second side edges of said rigid panel, said holes disposed to allow said threaded fasteners to removably engage said threaded orifices; and whereby, when said threaded fasteners are rotated to engage said threaded orifices, said rigid panel will be secured to said front rails in a closed position.

6. A multi-purpose convertible play yard convertibly adapted for use as a bassinet, changing table or bedside co-sleeper comprising;

a first enclosure having an open top, a floor, a front wall, and a first side wall and a second side wall, said first side wall and said second side wall each having a front edge and a top edge, said front edge connecting said first side wall and said second side wall to said front wall;

a rigid frame, said rigid frame supporting the first enclosure and having a lower front rail, a first vertical rail and a second vertical rail, said first and second vertical rails each having an upper end and a lower end, said first vertical rail being positioned adjacent said front edge of said first side wall and said second vertical rail being positioned adjacent to said front edges of said second side wall, a rigid panel, said rigid panel said rigid panel being selectively positionable between said first and said second vertical rails to form a closed position, said rigid panel having an upper and a lower edge and first and second side edges, said rigid panel extending from said first front vertical rail to said second front vertical rail and extending downwardly from the upper ends of said front vertical rails for a first distance when in said closed position;

rigid panel retainers for selectively securing said rigid panel to said frame in said closed position;

a second enclosure, said second enclosure being sized to fit substantially within the first enclosure and having an open top and a bottom;

an inner support, said inner support supporting the bottom of the second enclosure at a height above the height of the floor of the first enclosure; and a securing strap assembly for securing the play yard to a parental bed;

third and fourth receiving tracks, said receiving tracks being disposed upon said first and second front vertical rails and facing inwardly toward each other;

said receiving tracks extending from the upper ends of said front vertical rails downwardly; and an intermediate front horizontal rail, said intermediate rail being connected to said vertical rails and being spaced downwardly from the upper ends of said vertical rails;

wherein said front wall extends upward from said front lower rail to at least a point adjacent the lower edge of said rigid panel when said rigid panel is in said closed position, and further extending from said first front vertical rail to said second front vertical rail;

whereby, when the second enclosure is supported by the inner support and the rigid panel is in a closed position and the second enclosure is supported by the inner support, the play yard is usable as a bassinet;

wherein, when the rigid panel is moved from the closed position, the play yard is usable as a changing table; and further, when the securing strap assembly is properly positioned and the play yard is secured to the parental bed the play yard may serve as a co-sleeper;

wherein said rigid panel is sized and shaped to fit slidably and removably between said third and fourth receiving tracks to be disposed in said closed position;

whereby, when said rigid panel is removed from said third and fourth receiving tracks, the play yard is suitable for use as either a changing table or a co-sleeper, and when said rigid panel is in said closed position and said second enclosure is fitted, the play yard is suitable for use as a bassinet.

7. A multi-purpose convertible play yard convertibly adapted for use as a bassinet, changing table or bedside co-sleeper comprising;

a first enclosure having an open top, a floor, a front wall, and a first side wall and a second side wall, said first side wall and said second side wall each having a front edge and a top edge, said front edge connecting said first side wall and said second side wall to said front wall;

a rigid frame, said rigid frame supporting the first enclosure and having a lower front rail, a first vertical rail and a second vertical rail, said first and second vertical rails each having an upper end and a lower end, said first vertical rail being positioned adjacent said front edge of said first side wall and said second vertical rail being positioned adjacent to said front edges of said second side wall, a rigid panel, said rigid panel said rigid panel being selectively positionable between said first and said second vertical rails to form a closed position, said rigid panel having an upper and a lower edge and first and second side edges, said rigid panel extending from said first front vertical rail to said second front vertical rail and extending downwardly from the upper ends of said front vertical rails for a first distance when in said closed position;

rigid panel retainers for selectively securing said rigid panel to said frame in said closed position;

a second enclosure, said second enclosure being sized to fit substantially within the first enclosure and having an open top and a bottom;

an inner support, said inner support supporting the bottom of the second enclosure at a height above the height of the floor of the first enclosure;

a securing strap assembly for securing the play yard to a parental bed;

wherein said front wall extends upward from said front lower rail to at least a point adjacent the lower edge of said rigid panel when said rigid panel is in said closed position, and further extending from said first front vertical rail to said second front vertical raiL whereby, when the second enclosure is supported by the inner support and the rigid panel is in a closed position and the second enclosure is supported by the inner support, the play yard is usable as a bassinet;

wherein, when the rigid panel is moved from the closed position, the play yard is usable as a changing table; and further, when the securing strap assembly is properly positioned and the play yard is secured to the parental bed the play yard may serve as a co-sleeper; and wherein the play yard further comprises at least a pair of tubular receivers; and wherein said rigid panel further comprises first and second securing rods, said securing rods extending downwardly from the lower edge of said rigid panel and being sized, shaped and disposed to fit slidably within said receivers such that the rigid panel is in a closed panel when the securing rods are positioned within said receivers.

8. A multi-purpose convertible play yard convertibly adapted for use as a bassinet, changing table or bedside co-sleeper comprising;

a first enclosure having an open top, a floor, a front wall, and a first side wall and a second side wall, said first side wall and said second side wall each having a front edge and a top edge, said front edge connecting said first side wall and said second side wall to said front wall;

a rigid frame, said rigid frame supporting the first enclosure and having a lower front rail, a first vertical rail and a second vertical rail, said first and second vertical rails each having an upper end and a lower end, said first vertical rail being positioned adjacent said front edge of said first side wall and said second vertical rail being positioned adjacent to said front edges of said second side wall, a rigid panel, said rigid panel said rigid panel being selectively positionable between said first and said second vertical rails to form a closed position, said rigid panel having an upper and a lower edge and first and second side edges, said rigid panel extending from said first front vertical rail to said second front vertical rail and extending downwardly from the upper ends of said front vertical rails for a first distance when in said closed position;

rigid panel retainers for selectively securing said rigid panel to said frame in said closed position;

a second enclosure, said second enclosure being sized to fit substantially within the first enclosure and having an open top and a bottom;

an inner support, said inner support supporting the bottom of the second enclosure at a height above the height of the floor of the first enclosure;

a securing strap assembly for securing the play yard to a parental bed;

first and second positioning arms, said positioning arms having first and second ends, being pivotally mounted at their first ends to said first and second upper side horizontal rails and being pivotally mounted at their second ends to said first and second side edges of said rigid panel;

first and second threaded orifices, said first and second threaded orifices being disposed upon the first and second front vertical rails and facing toward said rigid panel when said rigid panel is disposed in said first, lowered position;

third and fourth threaded orifices, said third and fourth threaded orifices being disposed upon the first and second rear vertical rails and facing toward said rigid panel when said rigid panel is disposed in said second, raised position;

at least two threaded fasteners, said threaded fasteners being sized and shaped to threadedly engage said threaded orifices and being rotatably mounted to holes adjacent the first and second side edges of said rigid panel, said holes disposed to allow said threaded fasteners to removably engage said threaded orifices;

wherein said front wall extends upward from said front lower rail to at least a point adjacent the lower edge of said rigid panel when said rigid panel is in said closed position, and further extending from said first front vertical rail to said second front vertical rail;

whereby, when the second enclosure is supported by the inner support and the rigid panel is in a closed position and the second enclosure is supported by the inner support, the play yard is usable as a bassinet;

wherein, when the rigid panel is moved from the closed position, the play yard is usable as a changing table; and further, when the securing strap assembly is properly positioned and the play yard is secured to the parental bed the play yard may serve as a co-sleeper; and wherein said rigid panel being is movable from a closed position, to an open position wherein the upper edge of the rigid panel is disposed adjacent the rear upper horizontal rail;

whereby, when said rigid panel is in said closed position, all of the walls of the play yard will be of similar height;

whereby, when said threaded fasteners are rotated to engage said first and second threaded orifices, said rigid panel will be secured to said front vertical rails and when said threaded fasteners are rotated to engage said third and fourth threaded orifices, said rigid panel may be secured to the rear vertical rails thereby forming a rigid first enclosure having one lowered wall.

* * * * *